US010487541B1

(12) United States Patent
Zhang et al.

(10) Patent No.: US 10,487,541 B1
(45) Date of Patent: Nov. 26, 2019

(54) COMBINATION LOCK WITH ELECTRONIC OVERRIDE KEY

(71) Applicant: Digilock Asia Ltd., Lai Chi Kok, Kowloon (HK)

(72) Inventors: An Zhang, Shaoguan (CN); Asil Gokcebay, Petaluma, CA (US)

(73) Assignee: Digilock Asia Ltd., Kowloon (HK)

( * ) Notice: Subject to any disclaimer, the term of this patent is extended or adjusted under 35 U.S.C. 154(b) by 0 days.

(21) Appl. No.: 16/427,226

(22) Filed: May 30, 2019

(51) Int. Cl.

| | |
|---|---|
| ***E05B 37/00*** | (2006.01) |
| ***E05B 65/02*** | (2006.01) |
| ***E05B 47/00*** | (2006.01) |
| ***G07C 9/00*** | (2006.01) |
| ***E05B 41/00*** | (2006.01) |

(52) U.S. Cl.
CPC ..... *E05B 37/0034* (2013.01); *E05B 37/0058* (2013.01); *E05B 37/0096* (2013.01); *E05B 41/00* (2013.01); *E05B 47/0001* (2013.01); *E05B 65/025* (2013.01); *G07C 9/00571* (2013.01); *E05Y 2900/208* (2013.01); *G07C 2009/00769* (2013.01)

(58) Field of Classification Search
CPC ..... E05B 37/0034; E05B 37/0058; E05B 37/0096; E05B 41/00; E05B 47/0001; E05B 65/025; E05Y 2900/208; G07C 9/00571; G07C 2009/00769
USPC .... 70/284, 285, 303 A, 278.1; 340/5.2, 5.54
See application file for complete search history.

(56) References Cited

U.S. PATENT DOCUMENTS

| | | | | |
|---|---|---|---|---|
| 5,184,491 | A * | 2/1993 | Schittenhelm | E05B 37/08 70/278.1 |
| 5,228,730 | A | 7/1993 | Gokcebay et al. | |
| 5,245,329 | A | 9/1993 | Gokcebay | |
| 5,337,043 | A | 8/1994 | Gokcebay | |
| 5,367,295 | A | 11/1994 | Gokcebay et al. | |
| 5,552,777 | A | 9/1996 | Gokcebay et al. | |
| 5,592,408 | A | 1/1997 | Keskin et al. | |
| 5,816,083 | A | 10/1998 | Bianco | |
| 5,873,276 | A * | 2/1999 | Dawson | G07C 9/00912 340/5.54 |
| 5,881,589 | A * | 3/1999 | Clark | E05B 47/0012 70/278.7 |
| 5,886,644 | A | 3/1999 | Keskin et al. | |
| 5,894,277 | A | 4/1999 | Keskin et al. | |
| 6,000,609 | A | 12/1999 | Gokcebay et al. | |
| 6,374,653 | B1 | 4/2002 | Gokcebay et al. | |
| 6,552,650 | B1 | 4/2003 | Gokcebay et al. | |
| 6,655,180 | B2 | 12/2003 | Gokcebay et al. | |
| 6,791,450 | B2 | 9/2004 | Gokcebay et al. | |

(Continued)

*Primary Examiner* — Suzanne L Barrett
(74) *Attorney, Agent, or Firm* — Russell C. Petersen

(57) ABSTRACT

A combination lock can be operated manually via the manipulation of dials and by way of an electronic key. The lock includes one or more rotatable selectors each having multiple indicia disposed thereon. Rotation of the rotatable selectors to predetermined indicia places the lock in the unlocked position. The lock can further include an electronic port and an actuator. Upon receipt of a predetermined credential via the port, the actuator can place the lock in in the unlocked position. The lock further includes a knob that, when the lock is in the unlocked position, can be rotated between a first position in which the lock is in a closed position and a second position in which the lock is in an open position.

29 Claims, 25 Drawing Sheets

(56) References Cited

U.S. PATENT DOCUMENTS

| | | | | |
|---|---|---|---|---|
| 6,826,935 | B2 | 12/2004 | Gokcebay et al. | |
| 6,927,670 | B1 | 8/2005 | Gokcebay et al. | |
| 7,212,099 | B2 | 5/2007 | Zhai | |
| 7,336,150 | B2 | 2/2008 | Gokcebay et al. | |
| 7,367,207 | B2 * | 5/2008 | Yang | E05B 37/0034 70/213 |
| 7,397,343 | B1 | 7/2008 | Gokcebay et al. | |
| 7,444,844 | B1 * | 11/2008 | Lee | E05B 37/0034 70/21 |
| 7,628,047 | B2 * | 12/2009 | Lee | E05B 37/0034 70/134 |
| 7,958,757 | B1 * | 6/2011 | Lee | E05B 13/103 70/21 |
| 8,161,781 | B2 | 4/2012 | Gokcebay | |
| 8,490,443 | B2 | 7/2013 | Gokcebay | |
| 8,495,898 | B2 | 7/2013 | Gokcebay | |
| 8,769,999 | B2 | 7/2014 | Nave | |
| 8,860,574 | B2 | 10/2014 | Grant et al. | |
| 9,208,628 | B2 | 12/2015 | Gokcebay | |
| 9,222,283 | B1 * | 12/2015 | Zhang | E05B 9/086 |
| 9,222,284 | B2 * | 12/2015 | Gokcebay | E05C 3/042 |
| D749,932 | S | 2/2016 | Hollman | |
| 9,273,492 | B2 | 3/2016 | Gokcebay | |
| 9,422,746 | B1 | 8/2016 | Zhang et al. | |
| 9,536,359 | B1 | 1/2017 | Gokcebay | |
| 9,631,399 | B1 | 4/2017 | Zhang et al. | |
| 9,672,673 | B1 | 6/2017 | Gokcebay | |
| 9,702,166 | B2 | 7/2017 | Zhang | |
| 10,041,275 | B2 * | 8/2018 | Wu | E05B 37/02 |
| 10,135,268 | B1 | 11/2018 | Gokcebay | |
| 2004/0129044 | A1 | 7/2004 | DiVito | |
| 2006/0248932 | A1 * | 11/2006 | Yang | E05B 37/0031 70/284 |
| 2007/0056339 | A1 * | 3/2007 | Irgens | E05B 49/00 70/312 |
| 2009/0145178 | A1 | 6/2009 | Nave et al. | |
| 2012/0306617 | A1 | 12/2012 | Tung | |
| 2017/0221291 | A1 | 8/2017 | Gokcebay | |
| 2018/0033227 | A1 | 2/2018 | Gokcebay | |

* cited by examiner

COMBINATION LOCK WITH ELECTRONIC OVERRIDE KEY

FIELD OF THE INVENTION

The present subject matter is concerned with security of lockers, safes, desks, file cabinets, or other storage devices assigned for temporary or long-term use, especially lockers. In particular, disclosed herein is a mechanical combination lock, having no battery power, that includes an electronic key override. In one instance, the disclosed combination lock can be used in conjunction with a locker having a standard three-hole locker door prep layout, to replace a standard key or combination lock fitting the same locker door.

BACKGROUND OF THE INVENTION

Combination locks, such as those for lockers, are known. Lockers in secondary schools and health club locker rooms may include a mechanical combination lock with a mechanical key override. The mechanical key can be used when a student or a user has forgotten his or her combination, and an administrator can use the mechanical key to both open the lock and reset the combination. Moreover, a school administrator uses the mechanical key at the end of a school year to open all lockers, to individually re-set all combinations, then records the new combinations of each locker. Many of these locks have mechanical key lock cylinders inside the lock which are either not accessible to rekey or very labor intensive to remove, rekey, and reinstall. The administrator must do so to ensure that the older students who were previously assigned a locker do not have the combination for the forthcoming years. This process is laborious, time-consuming, and expensive. Moreover, if the administrator key is lost, the locks must be re-cored or re-keyed. Other mechanical combination locks having mechanical override keys are known. See, for example, U.S. Pat. No. 9,222,283, assigned to the assignee of the present application, U.S. Pat. Nos. 6,877,345, 7,444,844, 7,628,047, 7,958,757, 8,234,891, 8,316,675, and U.S. Patent Application Publication Nos. 2009/0301147 and 2008/0307838.

U.S. Pat. No. 8,769,999 describes a mechanical combination lock, where a mechanical key can be used with the lock to identify the unlocking combination. While it primarily describes a mechanical key, in a parenthetical it mentions an electronically operated mechanism that can identify the unlocking combination. But it fails to disclose any structure whatsoever for the electronically operated mechanism or how it operates.

Electronically-operated locks, moreover, are known as well. U.S. Pat. Nos. 5,886,644 and 5,894,277, owned by the assignee of this application, describe electronic locker locks to fit a standard three-hole door prep layout as well as other doors. The electronic locks described in those patents comprise two housings, mounted at front and back of the door, and electronically connected through the center hole of the three-hole door prep layout, and they included an electromagnetically-driven latch, retracted automatically by the lock device when the proper code was entered by a user, either via a keypad or an electronic ID device such as an iButton®. U.S. Pat. No. 8,161,781 likewise discloses an electronically-operated lock to fit a standard three-hole door prep. All three patents are incorporated herein by reference.

U.S. Pat. No. 9,121,199 discloses an electronic combination lock that can be operated via touchscreen and also with an electronic key. The same access code is sent to the microprocessor to open the lock, regardless of whether the access code is entered via the touchscreen or input via the electronic key.

There is a need for a mechanical combination lock that can be opened by an administrator or manager with an electronic key of relatively inexpensive construction, particularly for lockers but with more versatility as to use on various standard designs, modularity as to assembly and opposite-hand use, easy programmability and convenience and simplicity to the user. It would be particularly advantageous if the mechanical combination lock required no battery storage within its housing, but still permitted an electronic key to override the mechanical combination and unlock it. These are the goals of the lock described below.

SUMMARY OF THE INVENTION

A combination lock with electronic override that is configured to mount to a standard three-hole locker prep on a door is disclosed herein. The combination lock includes a knob that can be rotated between a first position in which the combination lock is in a closed position and a second position in which the combination lock is in an open position. A plate is fixed to the rotatable knob and, at least in part, defines a slot, and a locking slider is disposed in the slot. A rotatable drive shaft has a recess sized to selectively receive the locking slider, wherein when the locking slider is received in the recess, the knob is operatively connected to the drive shaft and the combination lock is in an unlocked position, and when the locking slider is not received in the recess, the knob is not operatively connected to the drive shaft, and the combination lock is in a locked position.

The combination lock can further include a circuit board including a microcontroller, and a port can be in communication with the microcontroller and configured to receive a credential. An actuator is in communication with the microcontroller and is operatively coupled to the locking slider, wherein upon receipt of a predetermined credential by the microcontroller, the microcontroller is configured to instruct that actuator to translate the locking slider into the recess of the drive shaft.

The combination lock can include one or more rotatable selectors each having multiple indicia disposed thereon and which are operatively coupled to the locking slider. Rotation of the rotatable selectors to a predetermined indicium is configured to selectively place the combination lock in the locked position and the unlocked position. When the combination lock is in the unlocked position, rotation of the knob causes rotation of the drive shaft to selectively place the combination lock in the closed position and the open position.

In one preferred example the combination lock does not include a battery compartment, and can receive the necessary electrical current for operating the actuator and microcontroller via an electrical input to the port.

DETAILED DESCRIPTION

Figure 1:
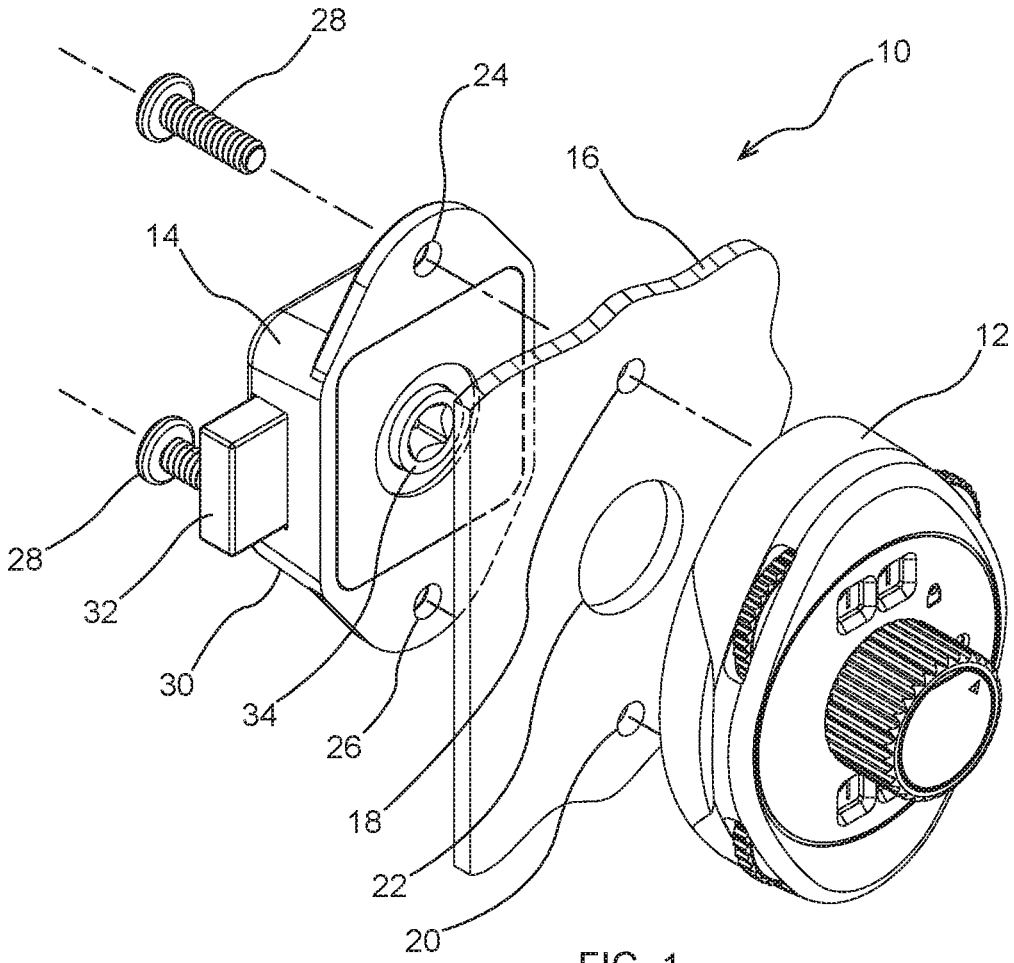
FIG. 1 is an exploded view in perspective of a first example of a combination lock with an electronic key override mounted to a locker door.
Figure 2:
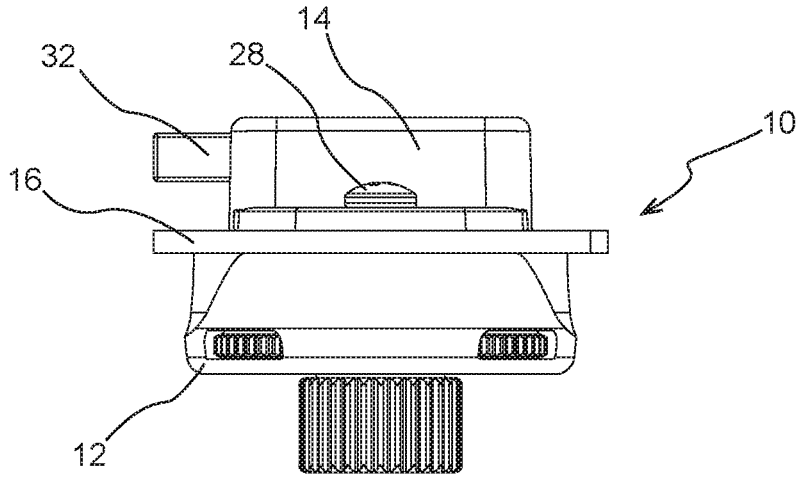
FIG. 2 is a top view of the combination lock and door of FIG. 1.

FIGS. 1 and 2 show a first example of a combination lock 10, including an outer housing 12 and locking mechanism 14, that is fixed to a door 16. In this example, the door 16 is a door for a locker, and has the standard three-hole door prep as known in the art, with two opposed mounting holes 18, 20 at top and bottom and a larger center hole 22. The locking mechanism 14 includes through holes 24, 26 that are coaxial with the mounting holes 18, 20 in the locker door, and the outer housing 12 includes internally threaded holes (not shown) likewise coaxial. The combination lock 10 can be mounted to the door 16 via threaded bolts 28 as depicted in FIG. 1. In other examples not shown, the combination lock 10 can be integral to the locker door 16 and therefore mounted permanently to the door 16. Moreover, the combination lock 10 and door 16 can be one of many in a system of lockers, such as in a school, locker room, or corporate environment. Further, the combination lock 10 can be employed in other enclosures, such as, for example, drawers, desks, cabinets, and other panels.

The locking mechanism 14 includes a housing 30, a bolt 32, and a rotatable shaft 34 operatively coupled to the bolt 32 in a known manner. Rotation of the shaft 34 90 degrees will retract the bolt 32 into the housing, such that the combination lock 10 is in the open position. Rotating the shaft 34 90 degrees counterclockwise will extend the bolt 32 out from the housing 30, as shown in FIGS. 1 and 2, such that the combination lock 10 is in the closed position.

Figure 3:
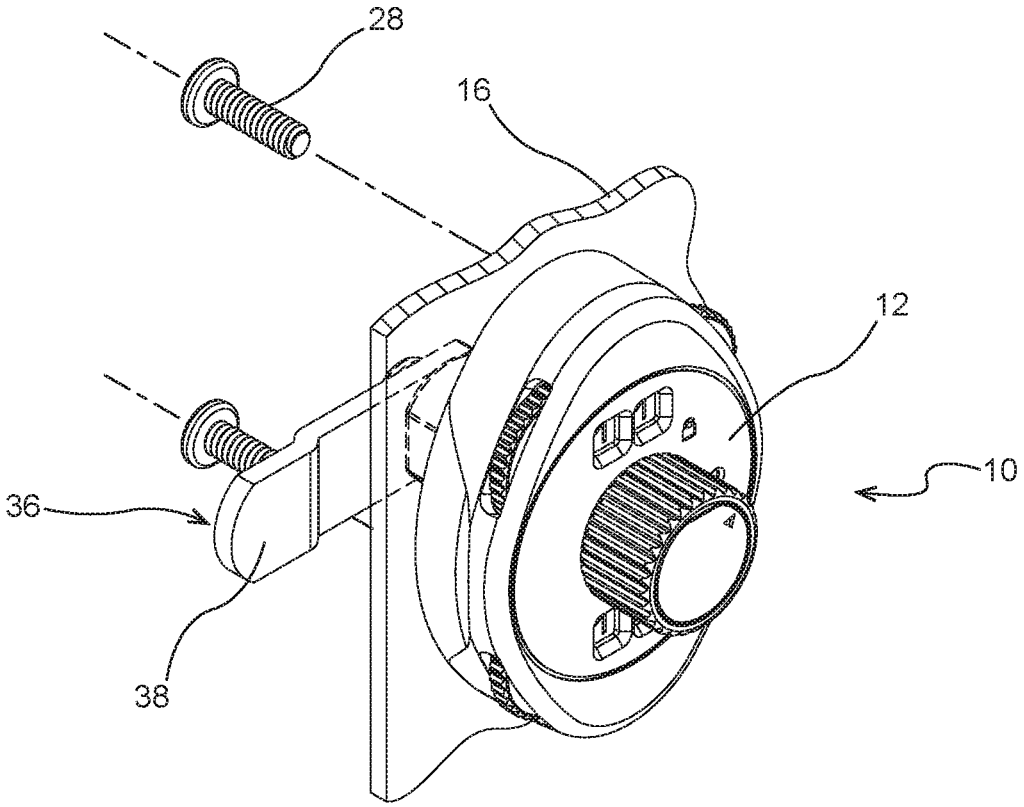
FIG. 3 is a perspective view of a second example of a combination lock, including the outer housing of FIG. 1 and an alternative locking mechanism.
Figure 4:
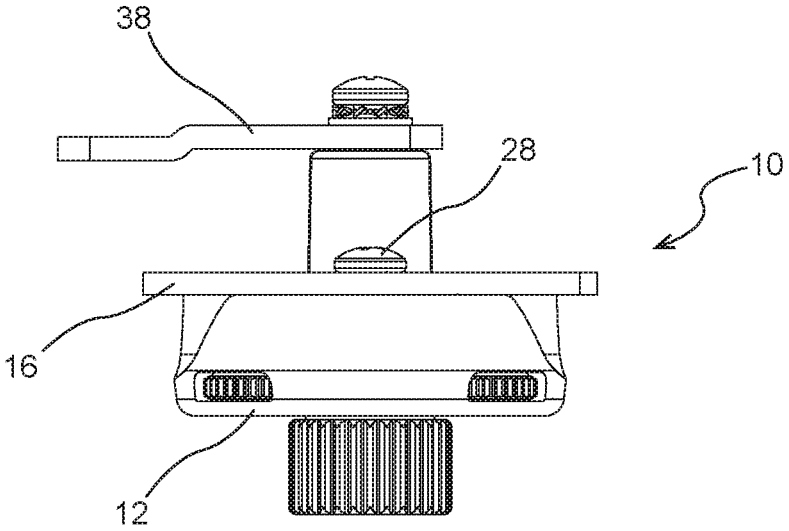
FIG. 4 is a top view of the combination lock of FIG. 3.

The bolt locking mechanism 14 is a typical application of a combination lock 10, and other locking mechanisms can be used. For example, FIGS. 3 and 4 depict a second example of a locking mechanism 36 operable with the outer housing 12 including a cam 38 that is likewise rotatable via operation of the combination lock 10. Rotation of the cam 38 while the door 16 is closed can place the cam 38 behind a strike plate or door frame to lock the door 16.

One of ordinary skill will understand that other locking mechanisms, such as slam-latch locking mechanisms, drop cam locking mechanisms, and the like, can be adapted to the combination lock 10. As is known, in a slam latch, the latch is spring loaded and has an angled face such that as the door is closing, the latch contacts a strike plate on the door frame and is pushed into the locking mechanism. Once the door is fully closed and the latch passes by the strike plate, however, the latch extends out again from the latch housing under the force of the spring, thereby maintaining the door closed. Again, rotation of the shaft 34 will retract the latch into the housing 12.

Figure 5:
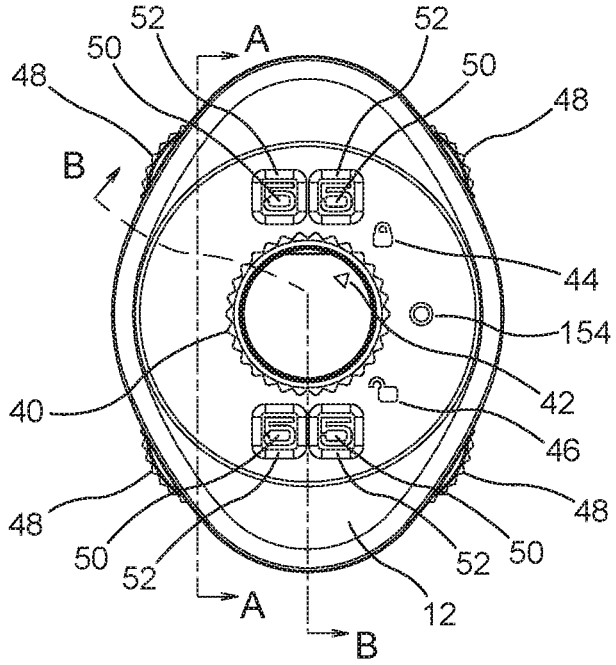
FIG. 5 is a front view of the outer housing of the combination lock of FIG. 1.

Referring now to FIG. 5, the outer housing 12 includes a rotatable knob 40 with an arrow indicator 42 disposed on it.

The outer housing 12 also includes a closed position symbol 44 and open position symbol 46. When the knob 40 is rotated such that the arrow indicator 42 points to the closed position symbol 44, as shown in FIG. 5, the combination lock is in the closed position, such that, for example, the bolt 32 is extended out from the housing 30 of the locking mechanism 14 (as shown in FIG. 1), or cam 38 is rotated down, and the door 16 is secured in a closed position. In this position, the bolt 32 or cam 38 can extend into a recess in or behind a frame of the locker (not shown), or into or behind a strike plate (not shown) affixed to the locker, to secure the locker door shut, as is known in the art. Referring back to FIG. 5, the knob 40 can be rotated counterclockwise so that the arrow indicator 42 points to the open position symbol 46, the combination lock 10 is in an open position. The bolt 32 is retracted into the housing 30 of the locking mechanism 14 (or the cam 38 is rotated upwardly) away from the frame of the locker or the locker strike plate, and a user can freely open and close the door 16. While the knob 40 is disclosed as generally cylindrical in shape, the knob 40 can also include a lever extending laterally outward to allow easier rotation of the knob 40.

The outer housing 12 further includes four rotatable dials 48, each with the indicia 50 printed on them. In this example, the indicia 50 are the numerals 0-9. The outer housing 12 also includes four windows 52 that each allow a single numeral to be viewed, and thereby indicate to the user the currently selected number for each dial. As will be described herein, selection of four pre-selected indicia 50 will place the combination lock 10 in an unlocked position.

Figures 6, 6A:
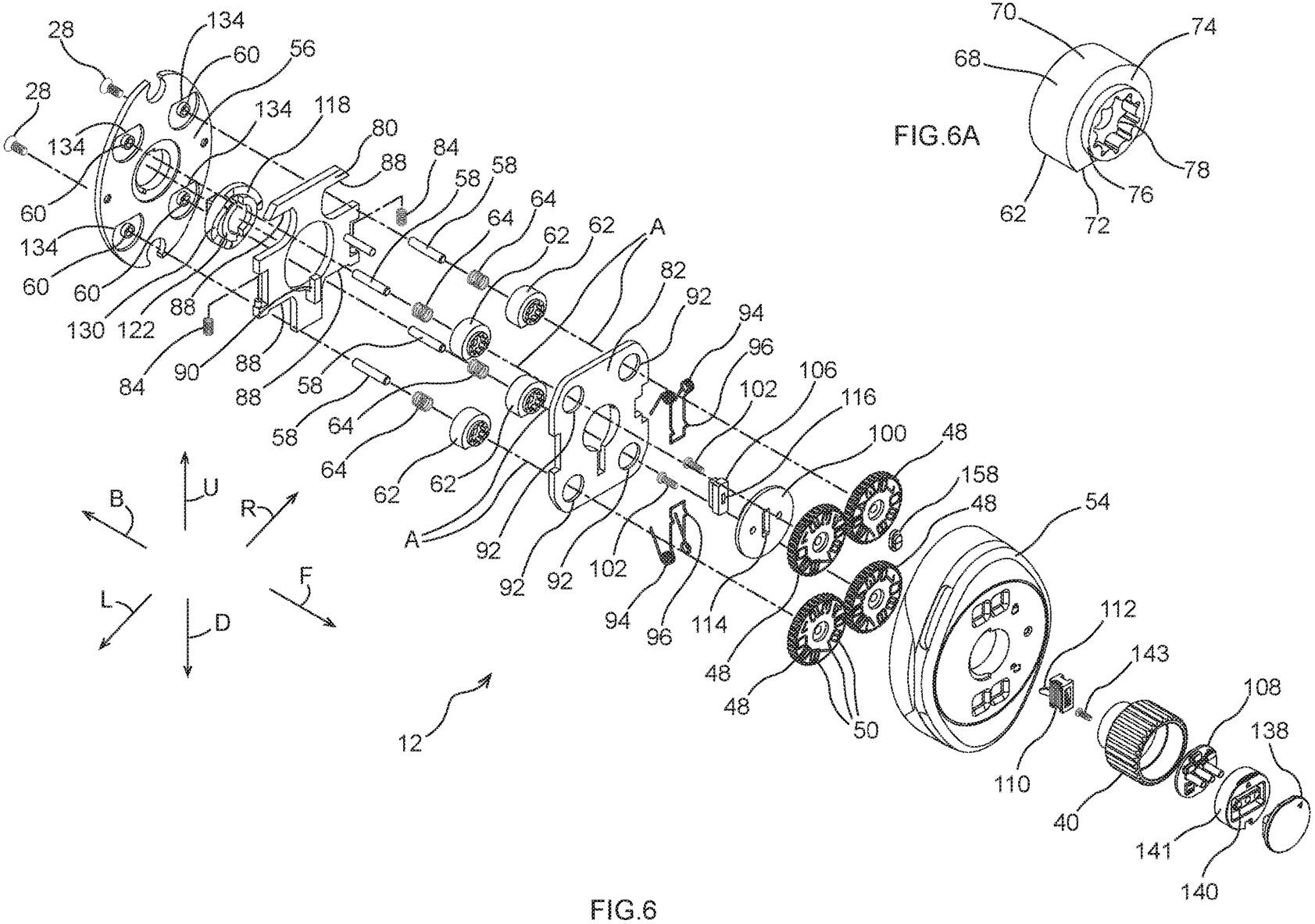
FIG. 6 is an exploded perspective view of the outer housing of the combination lock of FIG. 1.
FIG. 6*a* is a detail view of a cam wheel of FIG. 6.
Figure 7:
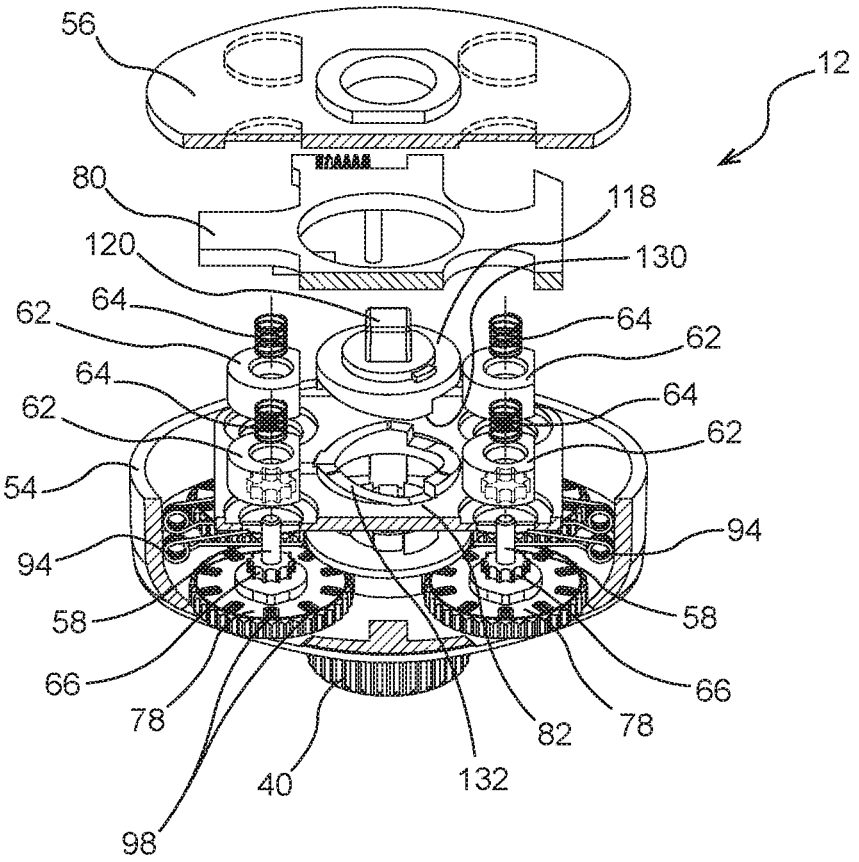
FIG. 7 is an exploded perspective view of the combination lock of FIG. 1 taken along line A-A in FIG. 5.

Referring now to FIGS. 6, 6*a*, and 7, the outer housing 12 further includes a casing 54 and a back plate 56. Dials shafts 58 extend from shaft recesses 60 in the back plate 56 to similar recesses (not shown) in the casing 54. Disposed on the dial shafts 58 are the rotatable dials 48, cam wheels 62, and cam springs 64. Moreover, as best shown in FIG. 7, disposed on the back of the rotatable dials 48 and affixed to the dials 48 are 10-point star drivers 66. The dial shafts 58 each define an axis A about which the rotatable dials 48 and cam wheels 62 rotate. As best seen in FIG. 6A, each of the cam wheels 62 have an outer periphery 68 that is generally D-shaped in cross-section with a curved section 70 and a flat section 72. Each of the cam wheels 62 further include a shoulder 74 with a cylindrical projection 76 extending in a direction F and a 10-point star recess 78 within the projection 76 that is complementary to the 10-point star drivers 66 of the rotatable dials 48. The cam springs 64 bias the cam wheels 62 away from the back plate 56 in direction F such that the star drivers 66 are normally engaged with the star recesses 78, and rotation of the dials 48 rotates the cam wheels 62 about axis A.

Also disposed within the outer housing 12 is a locking plate 80 and a cam plate 82. The locking plate 80 includes locking springs 84 that bear against posts 86 (best seen in FIG. 15) that extend rearwardly from the casing 54. The locking springs 84 bias the locking plate 80 in a downward direction D as shown in FIG. 6. The peripheries 68 of the cam wheels 62 bear on linear bearing surfaces 88 of the locking plate 80, and therefore rotational motion of the cam wheels 62, in combination with the biasing force of the locking springs 84, controls linear motion of the locking plate 80 in directions U and D. In other words, when the flat surfaces 72 of each of the four cam wheels 62 are engaged with the linear bearing surfaces 88 of the locking plate 80, the locking springs 84 bias the locking plate 80 and translate the locking plate 80 in direction D. The locking plate 80 also includes a push rod 90 that aids in the locking and unlocking of the combination lock 10, as will be described below.

The cam plate 82 includes four circular openings 92 that are coaxial with the dial shafts 58, and it is biased against the cam wheels 62 by cam plate springs 94 (only two of which are shown in FIG. 6). The shoulders 74 of the cam wheels 62 bear on the distal side of the cam plate 82 with the projections 76 of the cam wheels 62 extending through openings 92 in the cam plate 82 such that the cam wheels 62 rotate relative to the cam plate 82. The cam plate springs 94 include detents 96, and the rotatable dials 48 include complementary recesses 98 (see FIG. 7) corresponding to each indicium 50, such that when rotating the rotatable dials 48, the dial 48 will snap into place for each indicium 50 viewable through a window 52.

Figure 8:
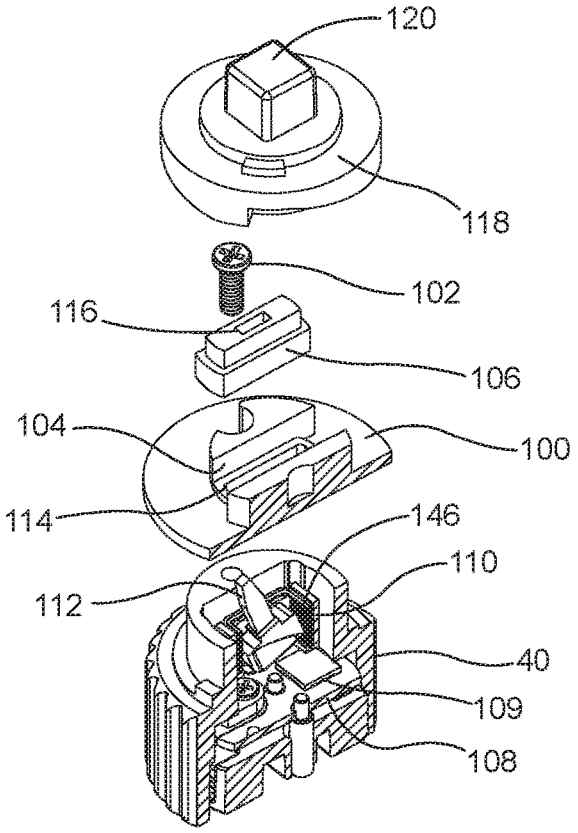
FIG. 8 is a partial cross-section and exploded detail view of a knob assembly and drive shaft of the combination lock.
Figure 9:
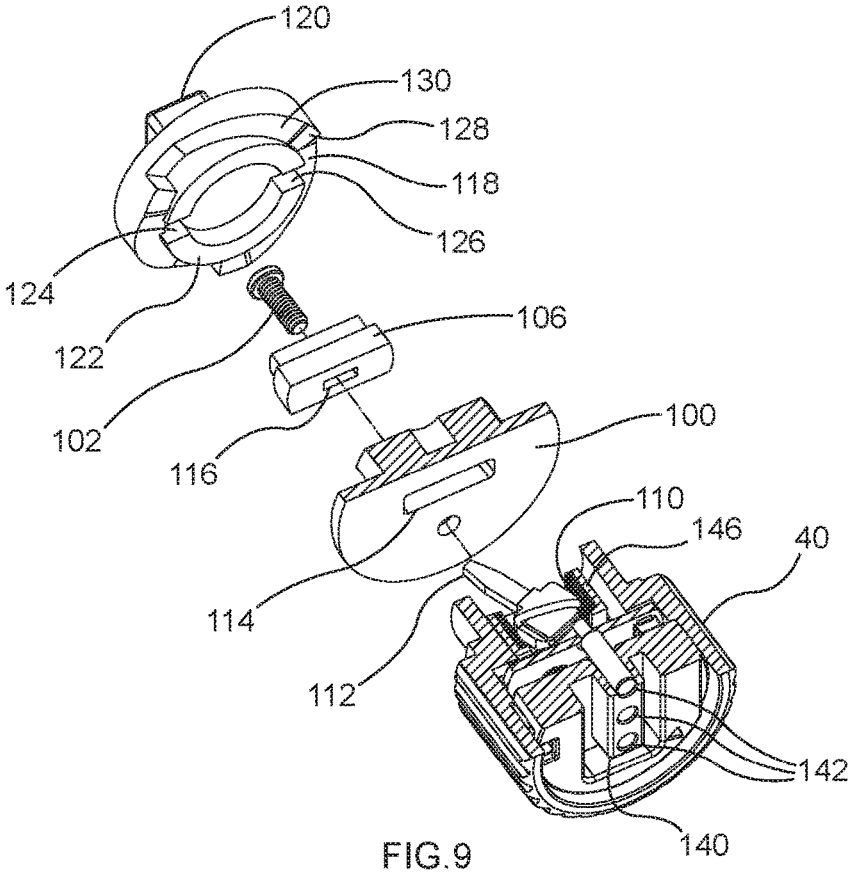
FIG. 9 is a second partial cross-section and exploded detail view of the knob assembly and drive shaft of the combination lock.
Figure 11:
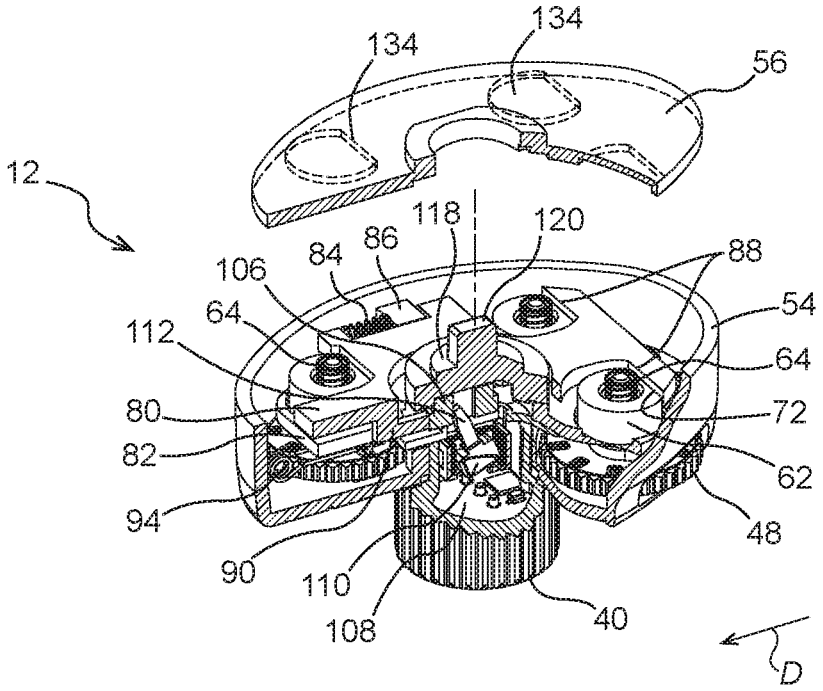
FIG. 11 is a partial cross-section view, taken along line B-B in FIG. 5, in which the outer housing is in the same position as in FIG. 10.

Referring now to FIGS. 6, 8, and 9, a retaining plate 100 is disposed in the outer housing 12 and is affixed to the knob 40 via screws 102. As best seen in FIGS. 8 and 9, the retaining plate 100 includes a slot 104 within which a locking slider 106 can slide back and forth. Accordingly, rotation of the knob 40 will likewise rotate the retaining plate 100 and the locking slider 106. As will be discussed in further detail later, disposed within the knob 40 is a circuit board 108 with a microcontroller 109 and a swing actuator 110 having an arm 112 that extends through a slotted hole 114 in the retaining plate 100 and into a recess 116 in the locking slider 106. Moreover, as best shown in FIGS. 6 and 11, the push bar 90 of the locking plate 80 engages the base portion of the locking slider 106, and the translational movement of the locking plate 80 in directions U and D, as described above, in combination with the swing actuator 110, serves to control movement of the locking slider 106 within the slot 104.

Also disposed within the outer housing 12 is a drive shaft 118. Extending from the distal side of the drive shaft 118 is a boss 120. The boss 120 extends through an opening in the back plate 56 of the outer housing 12, through the center hole 22 in the locker door 16, and into the rotatable shaft 34 of the locking mechanism 14. As can be seen and is known, rotation of the drive shaft 118 controls the locking mechanism 14.

On the proximal side of the drive shaft 118 is an inner cylinder 122 having upper and lower notches 124, 126 in the sidewall of the inner cylinder 122. The locking slider 106 is sized such that its length is shorter than the interior diameter of the inner cylinder 122, that it can freely rotate within the inner cylinder 122, and rotation of the knob 40 therefore does not engage the drive shaft 118. When the locking slider 106 is within the inner cylinder 122, the combination lock 10 is in the "locked position." The position of the locking slider 106 can be linearly shifted, however, such that it is disposed within either the upper notch 124 or the lower notch 126. In these positions, the locking slider 106 engages the inner cylinder 122, and rotation of the knob 40 will rotate the drive shaft 118. In this position, the combination lock is in the "unlocked position." The drive shaft 118 also includes an outer cylinder 128 that defines a cylindrical cam surface 130, which will be discussed in more detail below. The upper and lower notches 124, 126 are collectively referred to herein as a recess.

Figure 10:
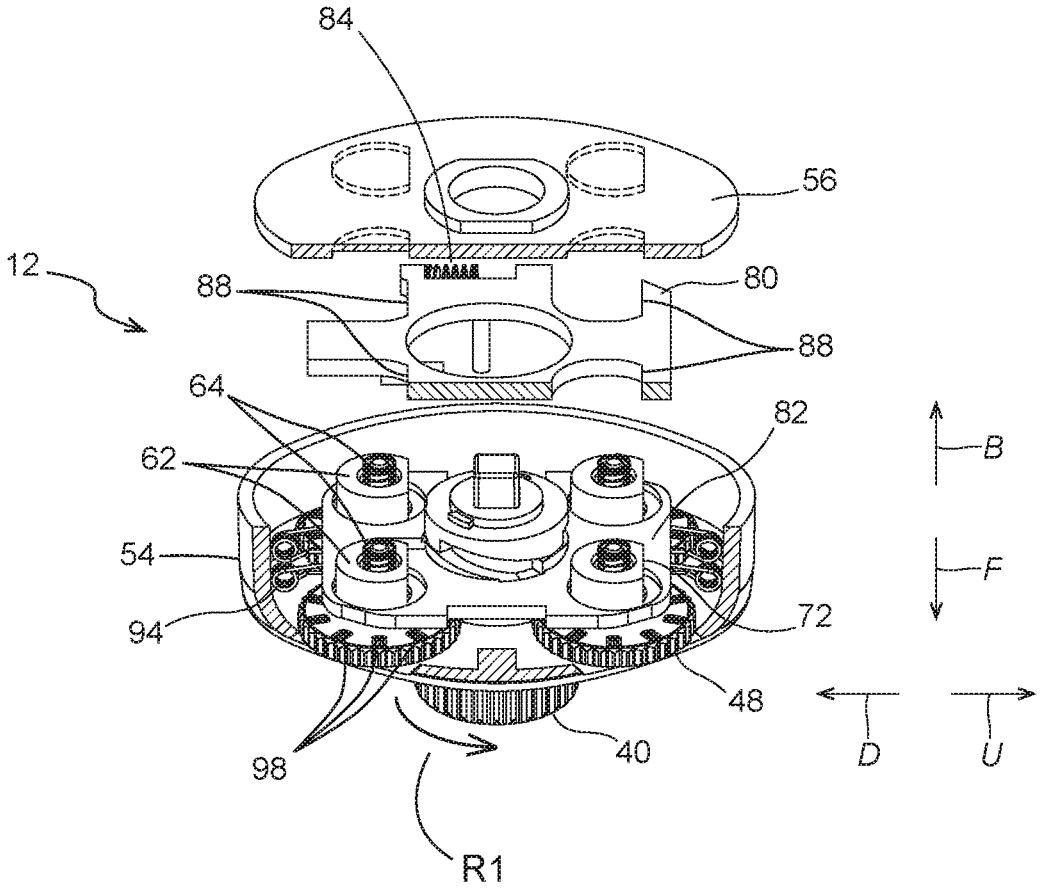
FIG. 10 is a partial cross-section view, taken along line A-A in FIG. 5, in which the outer housing of FIG. 1 is in the unlocked position, and the knob is pointed to the closed symbol.

The operation of the combination lock 10 will now be described. FIGS. 10 and 11 depict the outer housing 12 in the unlocked position, but the knob 40 still positioned such that it points to the closed position symbol 44; i.e., the user has unlocked the combination lock 10, but has yet to open it. The user has rotated the dials 48 to the pre-selected unlocking code such that the flat surfaces 72 of the cam wheels 62 engage the linear bearing surfaces 88 of the locking plate 80. Under the force of the locking springs 84, the locking plate 80 moves in direction D, thereby retracting the push rod 90 away from the locking slider 106. The biasing force of the swing actuator 110 pushes the locking slider 106 in direction D, thereby forcing the locking slider 106 into the lower notch 124 in the inner cylinder 122 of the drive shaft 118 (seen best in FIG. 9). Accordingly, it is now possible for the user to rotate the knob 40 to rotate the drive shaft 118 in direction R1 to move the combination lock 10 from the closed position to the open position.

Figure 12:
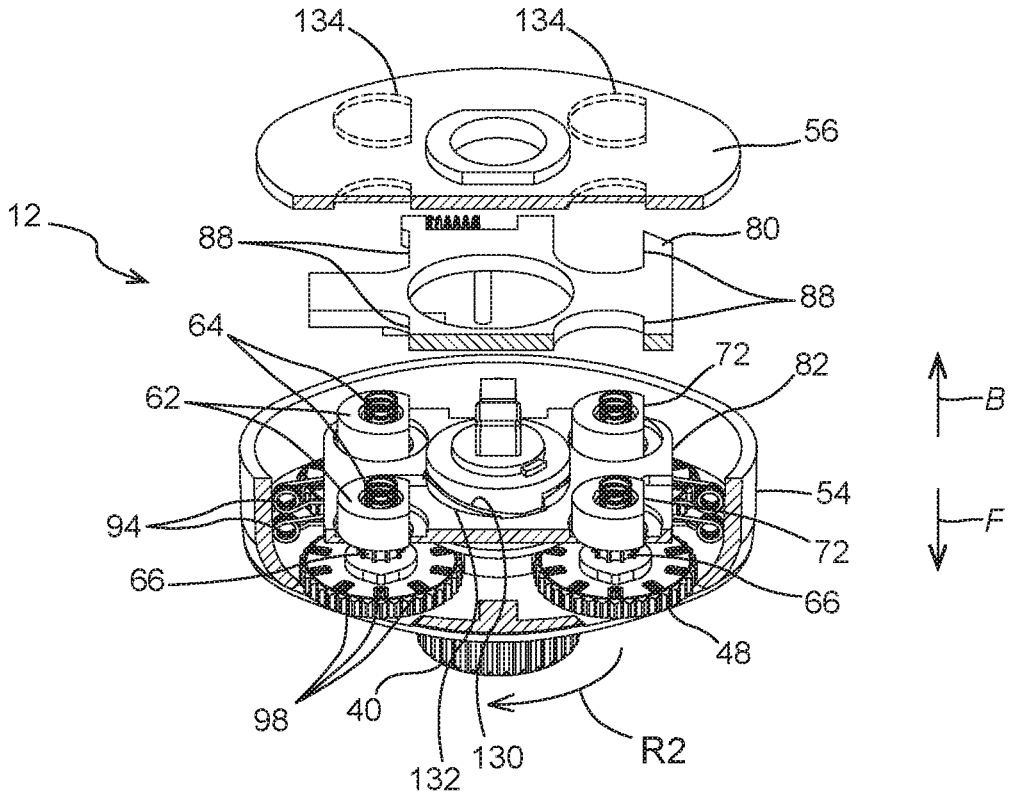
FIG. 12 is a partial cross-section view taken along line A-A in FIG. 5, in which the outer housing of FIG. 1 is in the unlocked position, and the knob is pointed to the open symbol.
Figure 13:
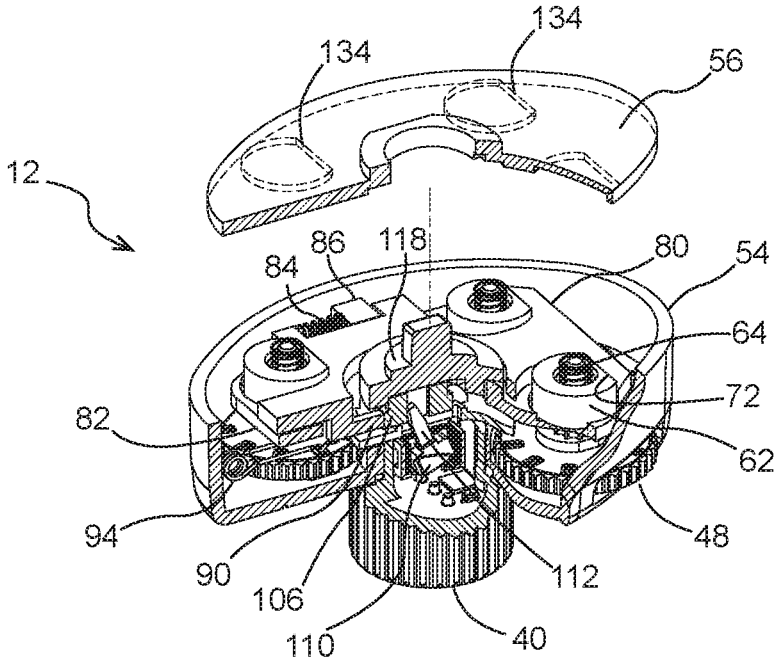
FIG. 13 is a partial cross section view, taken along line B-B in FIG. 5, in which the outer housing is in the same position as in FIG. 12.

FIGS. 12 and 13 depict the outer housing 12 in the unlocked position and the open position. In this position, the dials 48 and cam wheels 62 are in the same position as depicted in FIGS. 10 and 11, with the flat surfaces 72 of the cam wheels 62 bearing against the linear bearing surfaces 88 of the locking plate 80. In this position, however, the user has rotated the knob 40 90° counterclockwise, and the arrow indicator 42 on the knob 40 now points to the open position symbol 44. The bolt 32 is retracted into the housing 30 of the locking mechanism 14, and the user is free to open and close the locker door 16.

When the combination lock 10 is in the open position, the user can change the unlocking code. Rotation of the drive shaft 118 also rotates its cylindrical cam surface 130 relative to a cooperating cam surface 132 of the cam plate 82. When the combination lock 10 is in the closed position, such as shown in FIG. 10, the cylindrical cam surface 130 of the drive shaft 118 forces the cam plate 82 in direction F away from the back plate 56 of the outer housing 12. As the knob 40 is rotated and the combination lock 10 is placed in the open position, however, the cylindrical cam surfaces 130, 132 allow the cam plate 82 to move in direction B toward the back plate 56 of the outer housing 12. Moreover, the cam plate springs 94 overcome the force of the cam wheel springs 64, and the cam plate springs 94 force the cam plate 82 in direction B. The cam plate 82 thereby lifts the cam wheels 62 off of the 10-point star drivers 66 and into cooperating D-shaped recesses 134 in the back plate 56. Thus, when the combination lock 10 is in the open position, the cam wheels 62 are rotationally fixed by the recesses 134 in the back plate 56 and in the unlocked position. The dials 48 can be rotated independently of the cam wheels 62, and the cam wheels 62 will stay in the rotational position that places the combination lock 10 in the unlocked position. The user can therefore set the dials 48 to a new unlocking combination. Upon rotating the knob 40 in direction R2 back to the closed position shown in FIGS. 10 and 11, the cylindrical cam surfaces 130, 132 force the cam plate 82 in direction F, and the cam wheel springs 64 push the cam wheels 62 forwardly to again seat on the 10-point star drivers 66.

Figure 14:
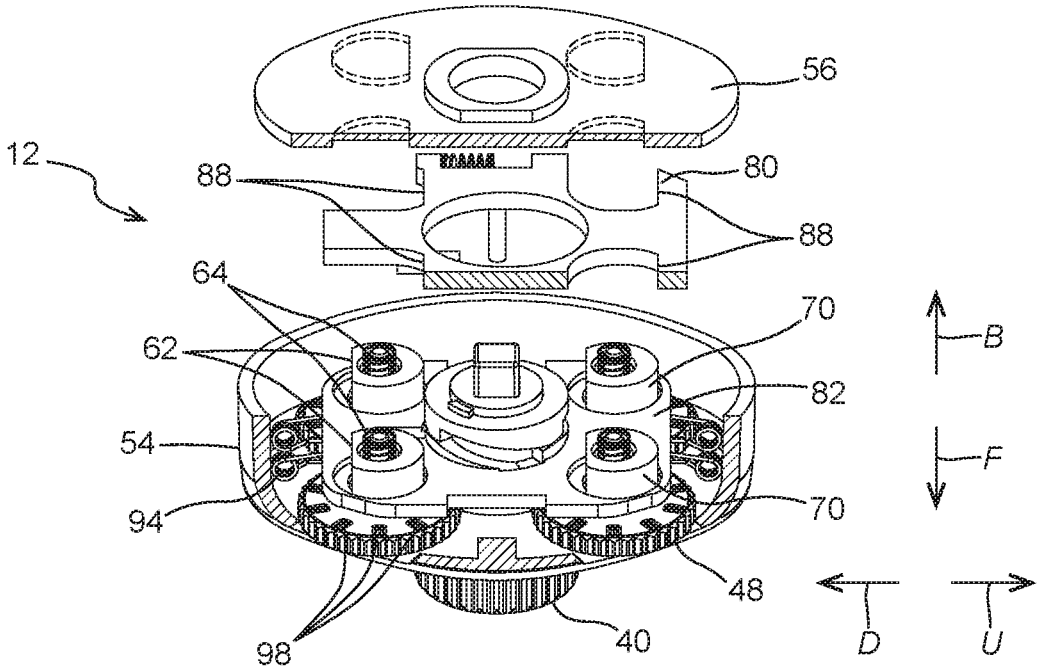
FIG. 14 is a partial cross-section view, taken along line A-A in FIG. 5, in which the outer housing of FIG. 1 is in the locked position, and the knob is pointed to the closed symbol.
Figure 15:
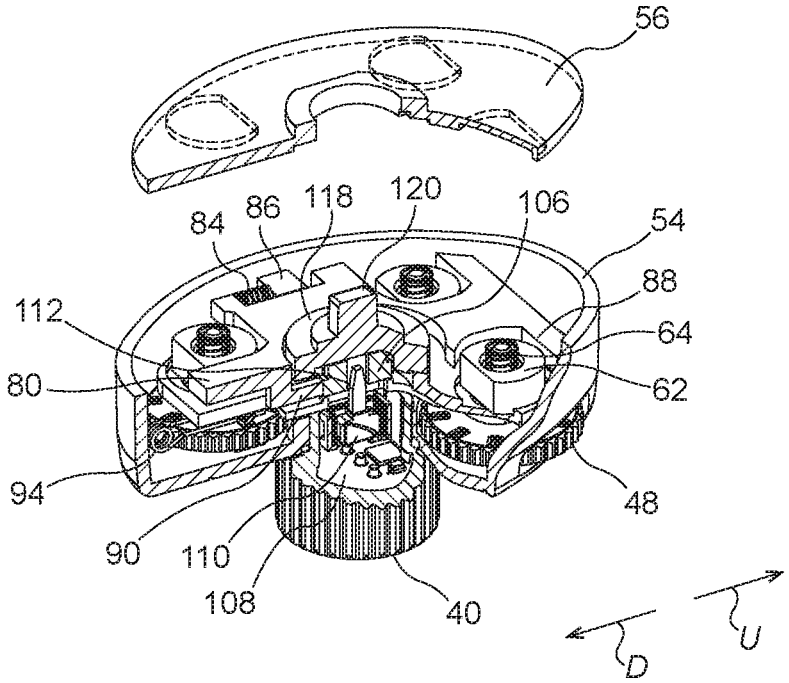
FIG. 15 is a partial cross-section view, taken along line B-B in FIG. 5, in which the outer housing is in the same position as in FIG. 14.

FIGS. 14 and 15 show the combination lock 10 while it is in the locked position and the knob 40 is rotated such that the arrow indicator 42 points to the closed position symbol 44. The rotatable dials 48 have been rotated so that the curved surfaces 70 of the cam wheels 62 engage the linear bearing surfaces 88 of the locking plate 80, thereby forcing the locking plate 80 in direction U, as seen in FIG. 14, and against the biasing force of the locking springs 84. The push rod 90 of the locking plate 80 engages the locking slider 106 and pushes it, again in direction U, so that the locking slider 106 is wholly contained inside the inner cylinder 122 of the drive shaft 118. The swing actuator 110 is biased in direction D, and thereby maintaining the locking slider 106 against the push rod 90. As mentioned earlier, the locking slider 106 is freely rotatable within the inner cylinder 122 of the drive shaft 118 when in the locked position, and therefore when the combination lock 10 is in the locked position, rotation of the knob 40 will not rotate the drive shaft 118. Note that the push rod 90 engages the base of the locking slider 106, and therefore does not interfere with the rotation of the locking slider 106 within the inner cylinder 122. The combination lock 10 cannot, therefore, move from the closed position to the open position.

Figure 16:
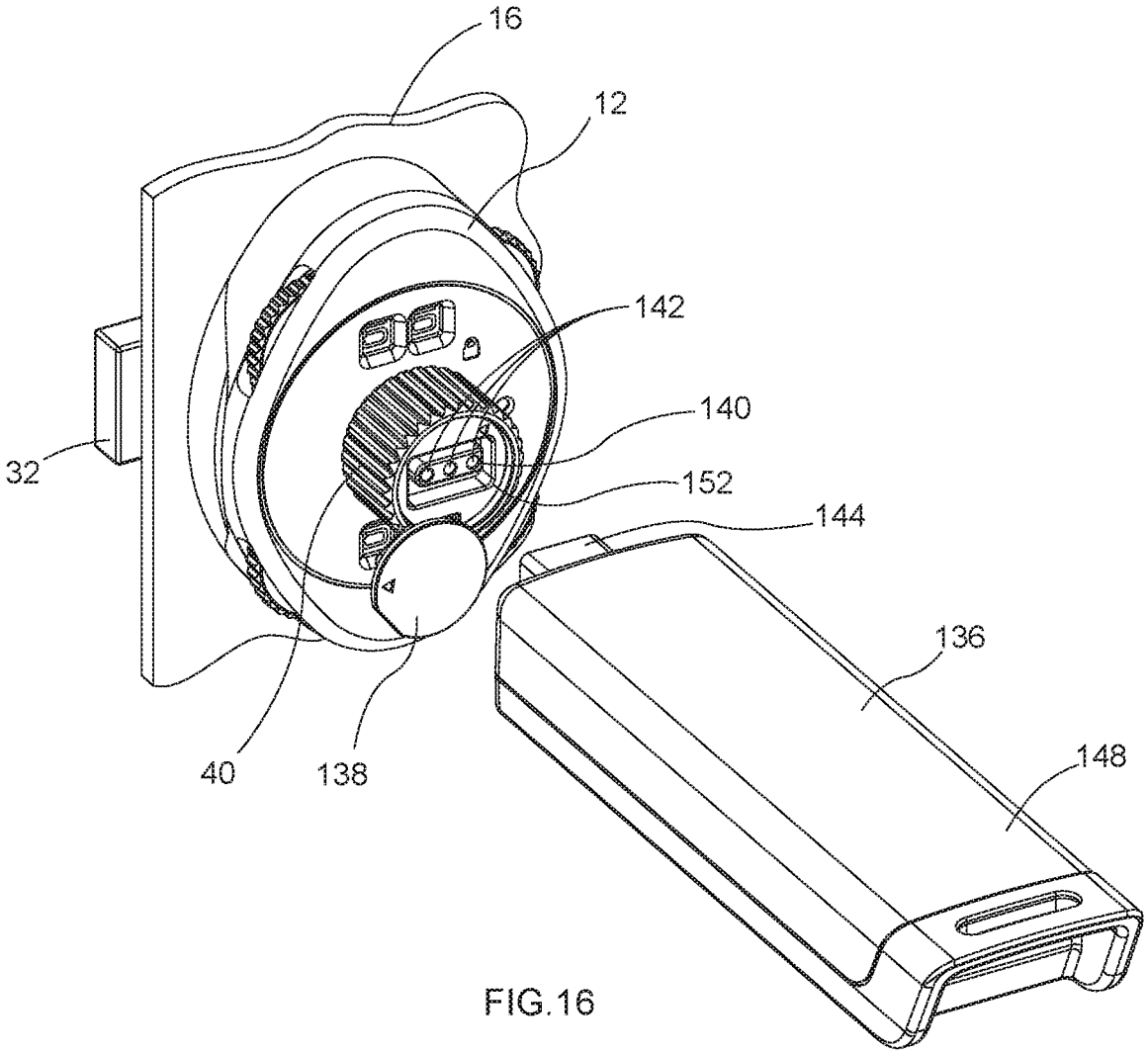
FIG. 16 is a front perspective view of the combination lock of FIG. 1 and an electronic override key.
Figure 17:
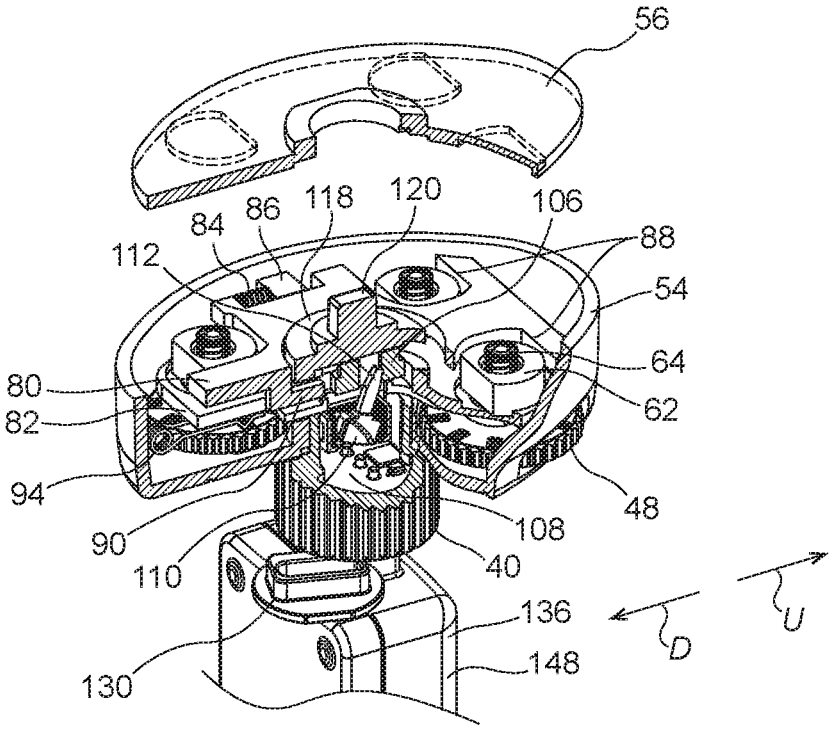
FIG. 17 is a partial cross-section view of the outer housing of FIG. 1, taken along line B-B in FIG. 5, in which the electronic key has overridden the mechanical combination lock and placed the outer housing into the unlocked position.

Referring now to FIGS. 16 and 17, an electronic key 136 can override the mechanical operation of the combination lock 10 and shift the combination lock 10 from the locked position to the unlocked position without regard to the position of dials 48 or cam wheels 62. The knob 40 includes a removable face plate 138 which, when removed, reveals an input or terminal or port 140 in a knob cap 141 for receiving the electronic key 136. The circuit board 108 is affixed to the knob cap 141 by a screw 143 (see FIG. 6). The port 140 includes three contacts 142 that serve to receive an electrical current and data from the electronic key 136. The terminal or port 140 preferably has a protective wall or collar 152, with the contacts 142 recessed inwardly, so as to protect those contacts 142. Other electrical connections that can transmit both data and current can also be used, such as the various USB ports, and the term port shall be understood to encompass all such connections.

The housing 12 further includes the circuit board 108 having the microcontroller 109 and memory which is connected to the port 140 (see FIGS. 8-9). In this case, the circuit board 108 is contained within the knob 40. Moreover, the swing actuator 110 includes a coil 146 that is connected to the circuit board 108. The microcontroller 109 is preprogrammed such that it can read and analyze a code passed to it by the electronic key 136 and compare it to a code stored in its memory. Although the term microcontroller is used herein, it will be understood by one of ordinary skill that any number of structures can be used to effectuate the functions described herein, e.g. controllers, processors, microprocessors, and addressable switches, and therefore the term microcontroller as used herein shall be understood to encompass all such structures.

Referring back to FIGS. 16 & 17, the electronic key 136 includes a housing 148 and three contacts (not shown) that mate with the contacts 142 of the port 140 and allow electrical communication between the two. Disposed within the housing 148 is a jump battery (not shown), which can be a rechargeable battery that is recharged using two of the three contacts, and circuitry capable of storing a master code or access code or both. The three contacts 142 of the port 140, and the mating contacts of the electronic key 136 are sufficient to transmit power from the jump battery using two of the contacts (a common and a power contact), and to communicate with the combination lock 10 using two of the contacts (the common and a data contact). The jump battery can be of sufficient voltage to provide the necessary current to power the operation of the combination lock 10, thereby eliminating the need for battery storage within the combination lock 10 itself. In other words, the outer housing 12 has no battery compartment and needs no batteries to permit the electronic key 136 to override the mechanical operation of the combination lock 10.

The contacts of the electronic key 136 can be spring-biased contacts or plug-in type contacts, with the contacts 142 of the port 140 being sockets in the case of a plug-in arrangement. As shown, the electronic key 136 preferably has a wall or collar 144 surrounding the contacts, so that the wall 144 fits closely within the collar 152 of the knob 40, with a complementary shape to assure correct orientation in engagement.

The internal circuitry of the electronic key 136 can include an access code or master code for all combination locks 10 in the system, communicated via two of the contacts to the combination lock 10 when the electronic key 136 is pushed against or plugged into the combination lock 10 as shown in FIG. 17. At the same time, the battery of the electronic key 136 will provide jump power to the combination lock 10. If desired, the casing 148 can have an external switch, such as a momentary switch, to switch on the power jumping function only when needed to conserve battery power, and not when the only problem is a lost electronic code. The design of the collars 144, 152 and the contacts provide protection against inadvertent shorting of the power.

The electronic key 136 can be pre-programmed to be multi-functional. For example, the electronic key 136 can be programmed to only open combination locks 10 during business hours to ensure that, should the key fall into the wrong hands, it cannot be operated after hours. Further, the electronic key 136 can include a memory to record operational data, such as the date and time it is used to open any combination lock 10, the identity of the combination lock 10 that has been opened, and so forth. Finally, the electronic key 136 can have differing levels of authorization, such as administrator keys and manager keys. Administrator keys can be restricted such that they, for example, may only be authorized to open the lock at certain times or they may only open lockers in certain locations (such as restricting staffers from opening locks in health club lockers in locker rooms of the opposite gender). They may further be programmed with an access code, whereby they can open a lock but not change the electronic code that opens the lock.

A manager key, however, may be programmed with a master code, which will both open the lock and set a new electronic code for the combination lock. This can be important if one of the administrator keys is lost or stolen. By setting a new code for a combination lock, the administrator keys are rendered inoperable until they are reprogrammed with the new code set by the administrator key. This process is far more efficient than re-coring and/or re-keying the lockers with mechanical override keys if a master key is lost. Other examples of items that can serve as an electronic key 136 could be, for example, smart phones, tablet computers, and laptop computers.

In another example of electronic keys 136, a key 136 can be configured to store a credential comprising a serial number and a revision number. The serial number is specific to the end user of the lockers, and may be specific to the location of the end user. In other words, an end user may have several sites, and each site may have its own serial number. Each credential also can include a revision number appended to the end of the serial number. By connecting a key 136 with this configuration to a lock 10 via the port 140, the key 136 will provide the credential that can electronically unlock the lock 10, and the microcontroller 109 will store the credential in memory. In the case of an end user losing a key 136, a new key 136 can be sent to the end user by the manufacturer having the same serial number but with a revision number incremented by one relative to the lost key 136. By connecting the new master key 136 to the port 140, the microcontroller 109 recognizes the incrementally-advanced revision number, then rewrites and stores the new credential in memory. Moreover, this process will work even if the revision number for the new key 136 is more than one higher than the current revision number. In other words, a key 136 with revision number four can update a lock have revision number 2 stored therein if any of the locks were forgotten in the previous round of updates. But the keys with the lower revision number will no longer be operable.

Although a key 136 is disclosed herein, it is contemplated that outer housing 12 could be adapted and or modified to include a wireless reader, such that a user could transmit a code wirelessly to the circuit board 108 via RFID, BLE, Bluetooth, NFC, or the like. In this scenario, the outer housing 12 would likely require batteries or line power to power the wireless reader. In this example, the wireless reader serves the same function as the port 140 and can be considered a port.

Referring now to FIG. 16, to operate the combination lock 10 with the electronic key 136, the user first opens the face plate 138 to expose the contacts 142 of the port 140. The user then inserts the contacts of the electronic key 136 into the contacts 142 of the port 140 to power the circuit board 108. The microcontroller reads the access code (or master code) from the electronic key 136; if it matches with the pre-programmed code stored in the memory associated with the microcontroller, the microcontroller allows the electronic key 136 to power the coil 146 of the swing actuator 110, and the magnetic field generated by the coil 146 pushes the magnet of swing actuator 110 to swing in direction U, thereby forcing the locking slider 106 into the upper slot 126 of the inner cylinder 122 of the drive shaft 118. The user can then rotate the knob 40, which will rotate the drive shaft 118, from the closed position to the open position, despite the dials 48 not being in the pre-selected unlocking combination.

If desired, the user can then re-set the unlocking combination. Because the dials 48 are not in the pre-selected unlocking combination, the cam wheels 62 will not initially be seated within the D-shaped recesses 134 of the back plate 56. The cam wheels 62 will be, however, forced against the back plate 56 due to the force of the cam plate springs 94. The user can rotate each dial 48 until he or she feels or hears the cam wheels 62 'click' into place within the recesses 130 (or rotate the cam wheels 360° in any event). At that point, with the cam wheels 62 will be secured in the recesses 130 and therefore in the unlocked position, the user can then rotate the dials 48 to select a new unlocking combination prior to rotating the knob 40 back to the closed position.

Figure 18:
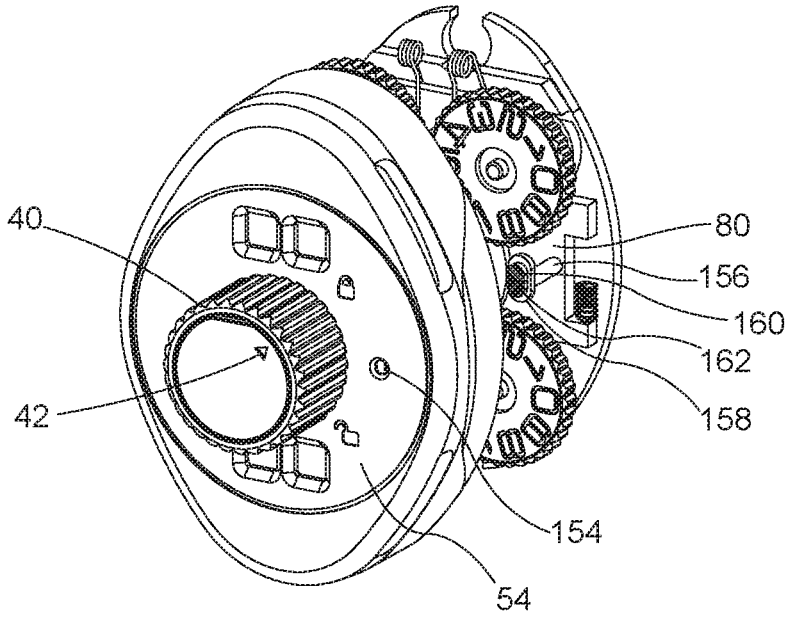
FIG. 18 is a partially-exploded perspective view of the outer housing of FIG. 1 depicting an indicator.

FIG. 18 depicts an indicator system that indicates to the user whether the combination lock 10 is in the locked position or the unlocked position. The outer housing 12 includes an opening 154 that serves as an indicator window. An indicator 156 extends forward from the locking plate 80 and includes a two-colored face 158. In this example, the indicator face 158 includes a red portion 160 and a green portion 162, but only one of the portions is visible through the indicator window 154 at a time. When the user places the dials 48 in the unlocking combination, the locking springs 84 push the locking plate 80 downwardly in the direction D, and the green portion 162 of the indicator 156 can be viewed through the indicator window 154. Similarly, when the user places the dials 48 in a locking combination, the cam wheels 62 force the locking plate 80 upwardly in a direction U, and the red portion 160 of the indicator 156 can be viewed through the indicator window 154.

The indicator system requires no power or current to provide the information to the user, and it therefore adds nothing to any power storage requirements of the combination lock 10.

Figure 19:
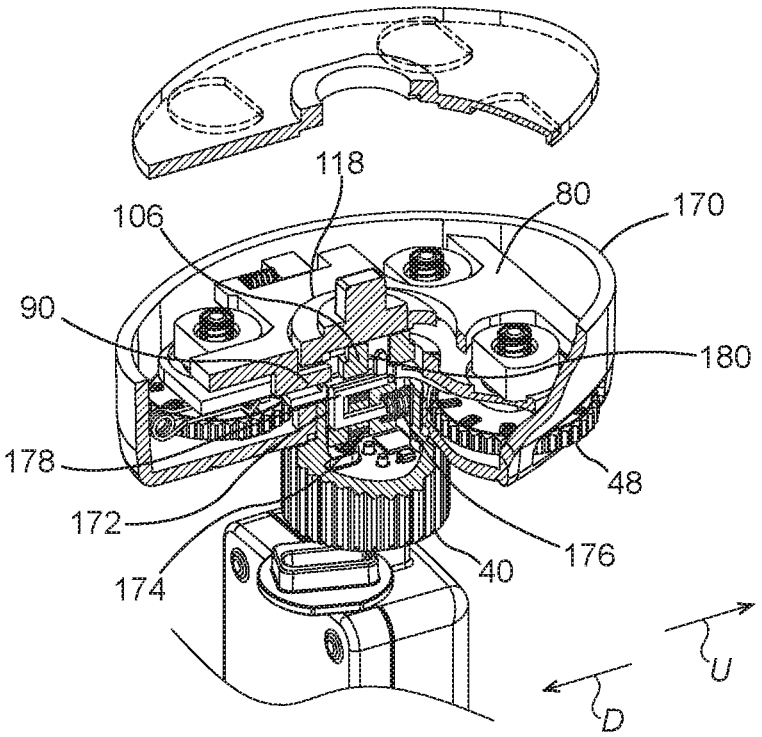
FIG. 19 is a partial cross-section view of a second example of an outer housing of the combination lock, taken along B-B in FIG. 5, which includes a second example of an actuating system, and in which the electronic key has overridden the mechanical combination lock and placed the lock into the unlocked position.

Referring now to FIG. 19, an outer housing 170 is depicted that is generally the same as outer housing 12 except for an alternative electronic actuator 172. The same numbers used in the previous examples reference the same elements in this example. The actuator 172 here is a linear solenoid actuator with a direction of travel in direction U. Other actuators, such as an electric motor, could be employed as well. The actuator 172 includes a coil 174, a spring 176, and a wrap-around shaft 178 having an end portion 180 that extends perpendicularly to direction U of the actuator 172. Similar to earlier embodiments, the end portion 180 of the shaft 178 extends into a recess 116 in the locking slider 106.

In other regards, the outer housing 170 operates similarly to the outer housing 12. When in the locked position, the push rod 90 maintains the locking slider 106 within the inner cylinder 122. The knob 40 rotates freely without engaging the drive shaft 118. When the user unlocks the outer housing 170 by rotating the dials 48, the locking plate 80 moves in direction D, the push rod 90 moves laterally in the same direction away from the locking slider 106, and the spring 176 biases the wrap-around shaft 178 in the same direction, such that the shaft 178 slides the locking slider 106 into the lower notch 124 of the inner cylinder 122. At this point, rotation of the knob 40 will rotate the drive shaft 118.

Alternatively, the user can electronically override the lock by way of the key 136 or other electronic means, and the actuator 172 will drive the wrap-around shaft 178 in direction U such that the slider 106 slides into upper notch 126 of the inner cylinder 122. Again, rotation of the knob 40 will rotate the drive shaft 118.

Figure 20:
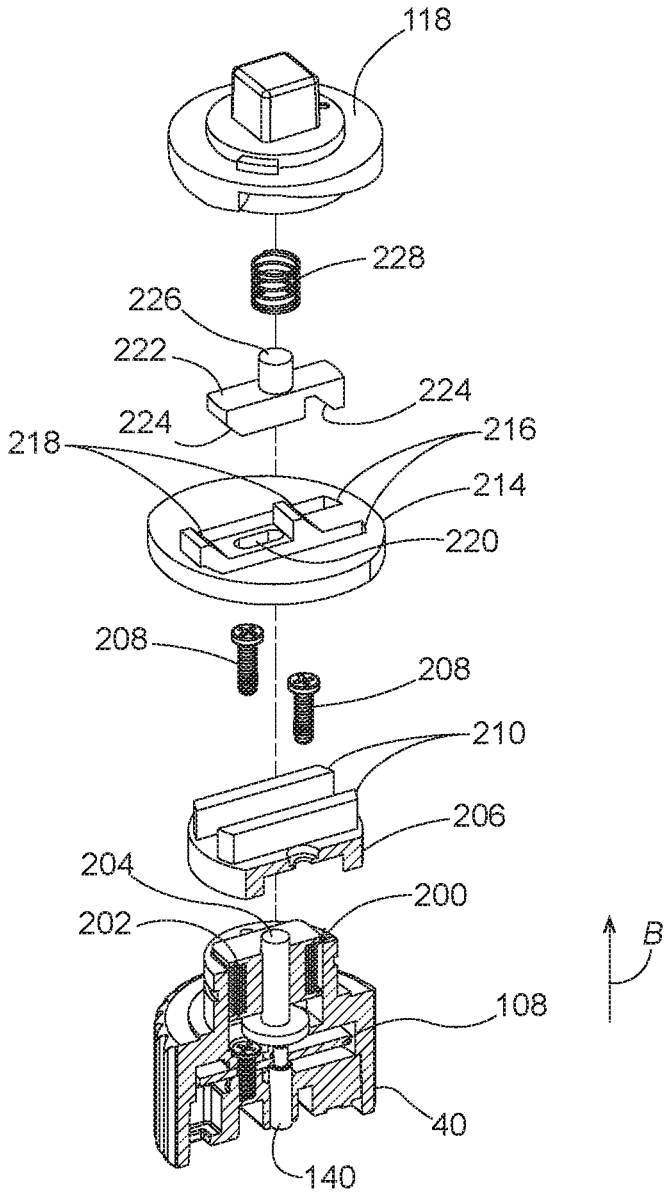
FIG. 20 is a partial cross-section and exploded detail view of a knob assembly and drive shaft of the outer housing, detailing a third example of an actuating system.
Figure 21:
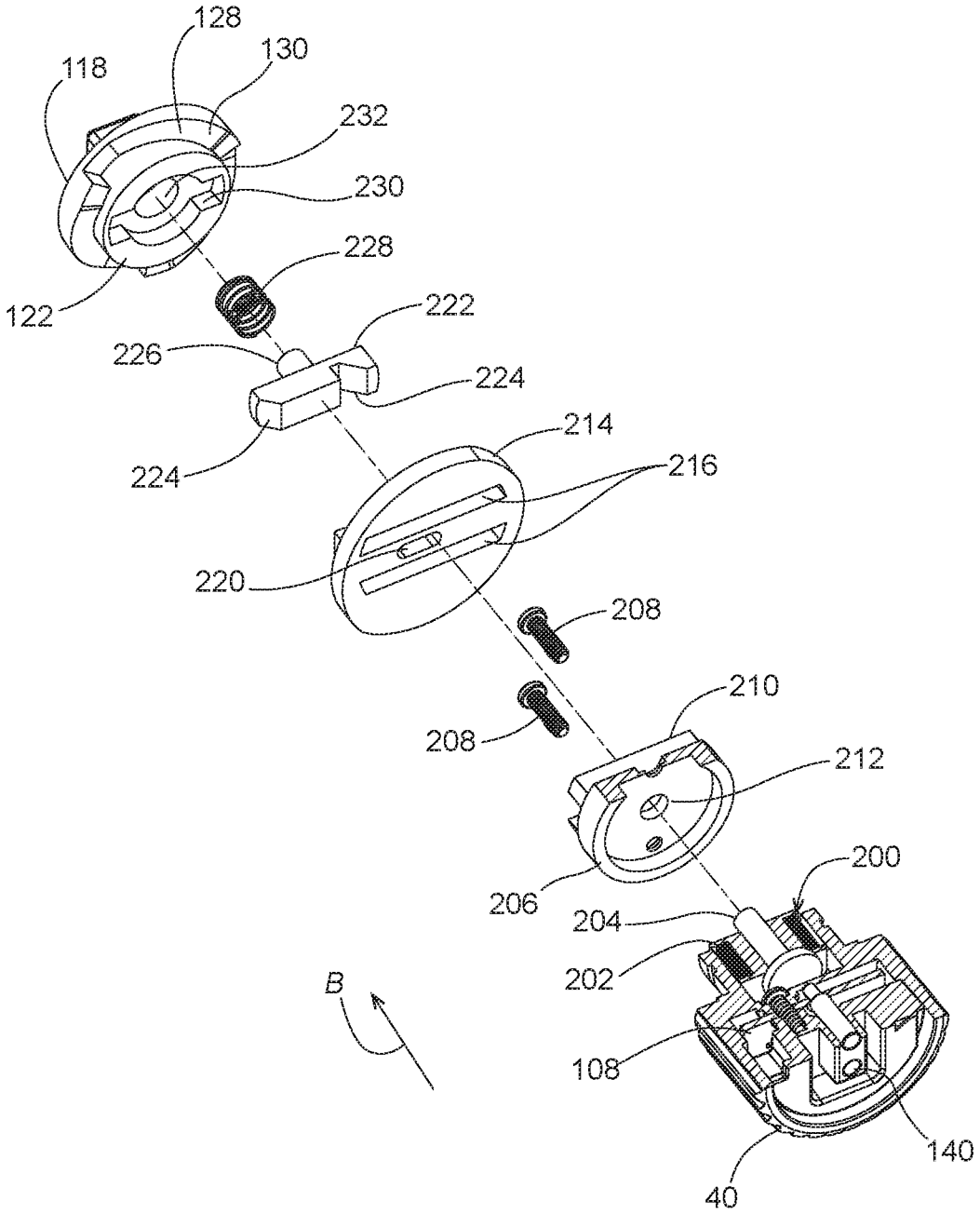
FIG. 21 is a second partial cross-section and exploded detail view of the knob assembly and drive shaft of FIG. 20.

FIGS. 20 & 21 depict another example of a system for shifting the outer housing 12 between the locked position and the unlocked position. Disclosed is a knob 40 including a port 140 and a circuit board 108, similar to the previous embodiments. A linear solenoid actuator 200 is further disclosed that includes a coil 202 and a push rod 204. Unlike previous embodiments, the direction of actuation of the push rod 204 is in direction B, i.e., toward the back plate 56.

A retaining plate 206 is affixed to the knob 40 via two screws 208. The retaining plate 206 includes two tongues 210 extending upwardly in parallel and a push rod hole 212 that allows the push rod 204 to traverse through it. A sliding plate 214 is disposed on the retaining plate 206 and includes parallel passages 216 that are configured to receive the tongues 210. The passages 216 in the sliding plate 214 are longer than the tongues 210, and so sliding plate 214 can slide laterally relative to the retaining plate 206 in a direction perpendicular to direction B. The tongues 210 have a height that is greater than the thickness of sliding plate 214 and therefore extend above the top surface of the sliding plate 214 to form a slot therebetween. The sliding plate 214 further includes a pair of ramps 218 disposed between the passages 216 and a push rod slot 220 through which the push rod 204 can traverse.

A locking slider 222 is disposed on the sliding plate 214 in the slot defined by the tongues 210 extending up through the passages 216 from the retaining plate 206. On the bottom of the locking slider 222 is a pair of ramp followers 224 configured to interact with the ramps 218 such that translational movement of the sliding plate 214 results in movement of the locking slider 222 in direction B. The locking slider 222 further includes a post 226 extending upwardly, and a spring 228 is disposed about the post 226.

Like in previous examples, a drive shaft 118 includes an outer cylinder 128 having a cam surface 130 and an inner cylinder 122. But unlike in previous examples, disposed within the inner cylinder 122 in this example is a slotted recess 230 configured to receive the locking slider 222 and a post recess 232 configured to receive the post 226 of the locking slider 222. Accordingly, when the sliding plate 214 translates laterally, the ramps 218 force the locking slider 222 in direction B into the slotted recess 230, such that rotation of the knob 40 now causes rotation of the drive shaft 118. Typically, the spring 228 biases the locking slider 222 away from and out of the slotted recess 230.

Figure 22:
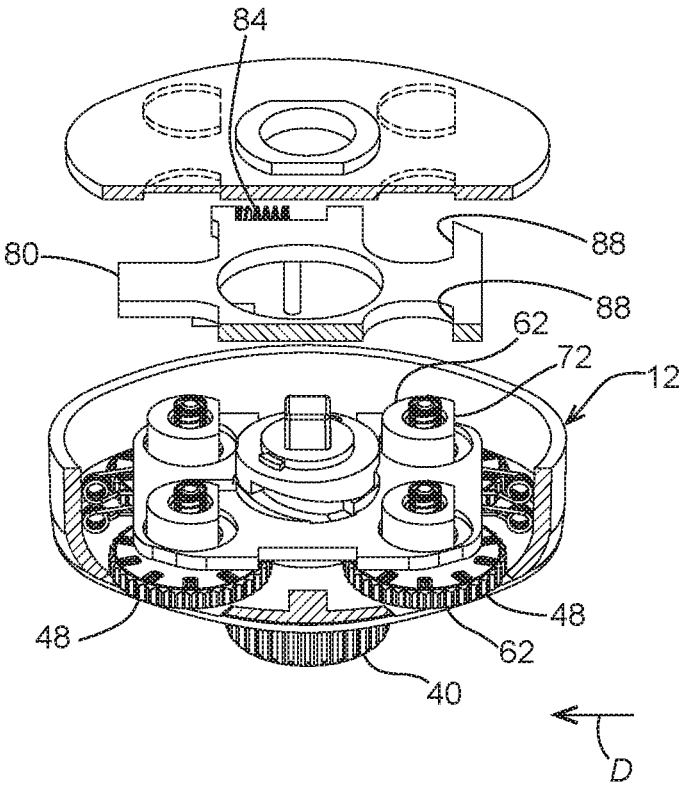
FIG. 22 is a partial cross-section view of a third example of an outer housing of the combination lock, taken along line A-A in FIG. 5, having the third exemplary actuating system disclosed in FIG. 20, in which the outer housing is in the unlocked position, and the knob is pointed to the closed symbol.
Figure 23:
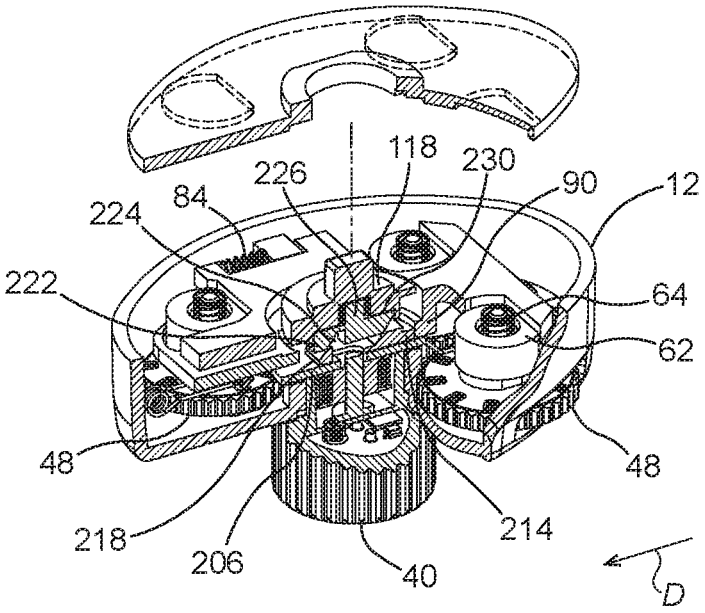
FIG. 23 is a partial cross section view, taken along line B-B in FIG. 5, of the outer housing disclosed in FIG. 22, in which the outer housing is in same position as in FIG. 22.

Referring now to FIGS. 22 and 23, the outer housing 12 is in the unlocked position, but the knob 40 still positioned such that it points to the closed position symbol 44; i.e., the user has unlocked the combination lock 10, but has yet to open it. The user has rotated the dials 48 to the pre-selected unlocking code such that the flat surfaces 72 of the cam wheels 62 engage the linear bearing surfaces 88 of the locking plate 80. Under the force of the locking springs 84, the locking plate 80 has moved in direction D, thereby forcing the push rod 90 toward the sliding plate 214. The sliding plate 214 translates laterally in direction D, and its lateral motion is constrained by the tongues 210 disposed in the slots 216 as described above. The ramps 218 of the sliding plate 214 interact with the ramp followers 224 of the locking slider 222, and force locking slider 222 upwardly into the slotted recess 230 of the drive shaft 118. Accordingly, it is now possible for the user to rotate the knob 40 to rotate the drive shaft 118 to move the combination lock 10 from the closed position to the open position.

Figure 24:
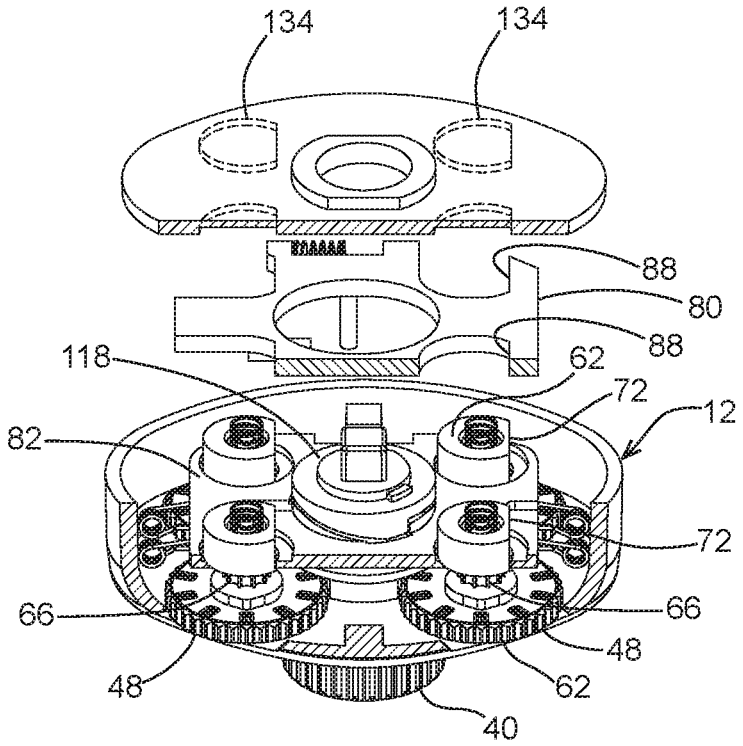
FIG. 24 is a partial cross-section view taken along line A-A in FIG. 5, of the outer housing disclosed in FIG. 22, in which the outer housing is in the unlocked position, and the knob has been rotated to the open symbol.
Figure 25:
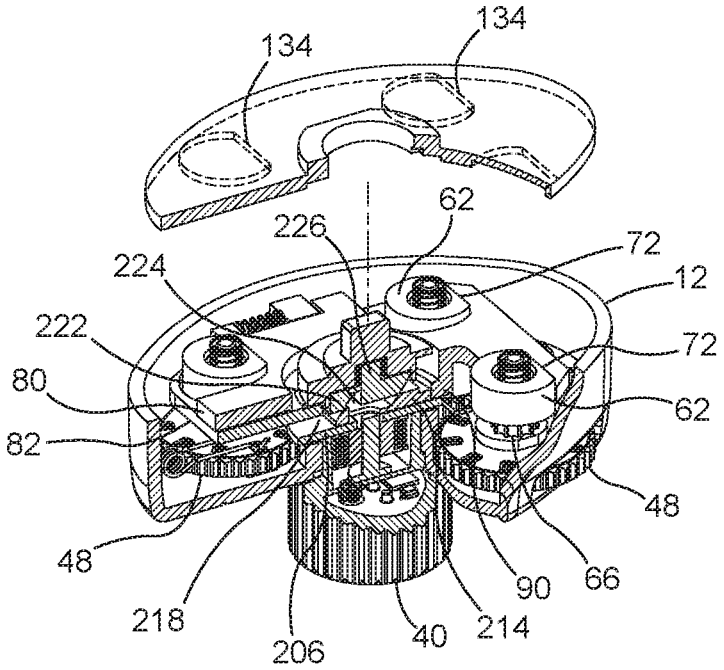
FIG. 25 is a partial cross-section view taken along line B-B in FIG. 5, of the outer housing disclosed in FIG. 22, in which the outer housing is in the same position as in FIG. 24.

Referring now to FIGS. 24 and 25, the dials 48 remain rotated to the pre-selected unlocking code such that the flat surfaces 72 of the cam wheels 62 engage the linear bearing surfaces 88 of the locking plate 80. In this position, however, the user has rotated the knob 40 90° counterclockwise, and the arrow indicator 42 on the knob 40 now points to the open position symbol 44. The bolt 32 is retracted into the housing 30 of the locking mechanism 14, and the user is free to open and close the locker door 16. The action of the cam plate 82 lifting the cam wheels 62 off the star drivers 66 and into the D-shaped recesses 134 is the same as described with respect to FIGS. 12 and 13.

Figure 26:
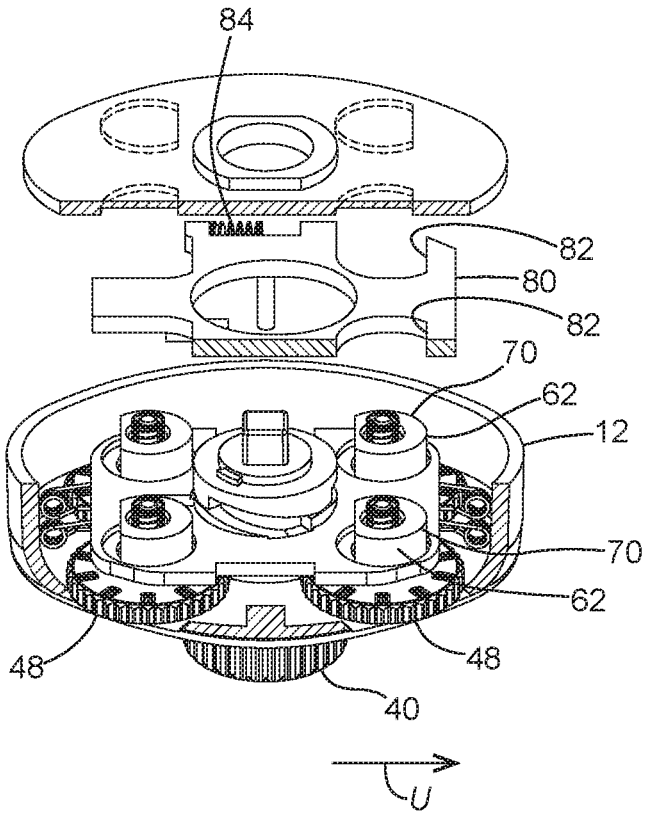
FIG. 26 is a partial cross-section view, taken along line A-A in FIG. 5, of the outer housing disclosed in FIG. 22, in which the outer housing is in the locked position, and the knob is pointed to the closed symbol.
Figure 27:
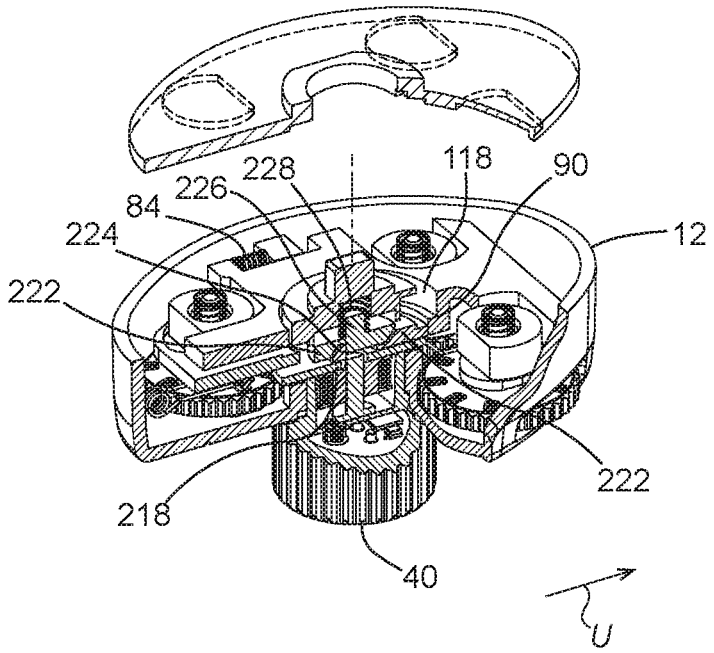
FIG. 27 is a partial cross-section view, taken along line B-B in FIG. 5, of the outer housing disclosed in FIG. 22, in which the outer housing is in the same position as in FIG. 26.

FIGS. 26 and 27 show the outer housing while it is in the locked position and the knob 40 is rotated such that the arrow indicator 42 points to the closed position symbol 44. The rotatable dials 48 have been rotated so that the curved surfaces 70 of the cam wheels 62 engage the linear bearing surfaces 88 of the locking plate 80, thereby forcing the locking plate 80 in direction U, as seen in FIG. 26, and against the biasing force of the locking springs 84. The push rod 90 of the locking plate 80 retracts from the sliding plate 214, and the spring 228 pushes the locking slider 222 downwardly, forcing the sliding plate 214 in direction U due to the interaction of the ramps 218 and the ramp followers 224, and further forcing the locking slider 222 and out of the slotted recess 230. The locking slider 222 no longer engages the drive shaft 118, and therefore when the combination lock 10 is in the locked position, rotation of the knob 40 will not rotate the drive shaft 118. The combination lock 10 cannot, therefore, move from the closed position to the open position.

Figure 28:
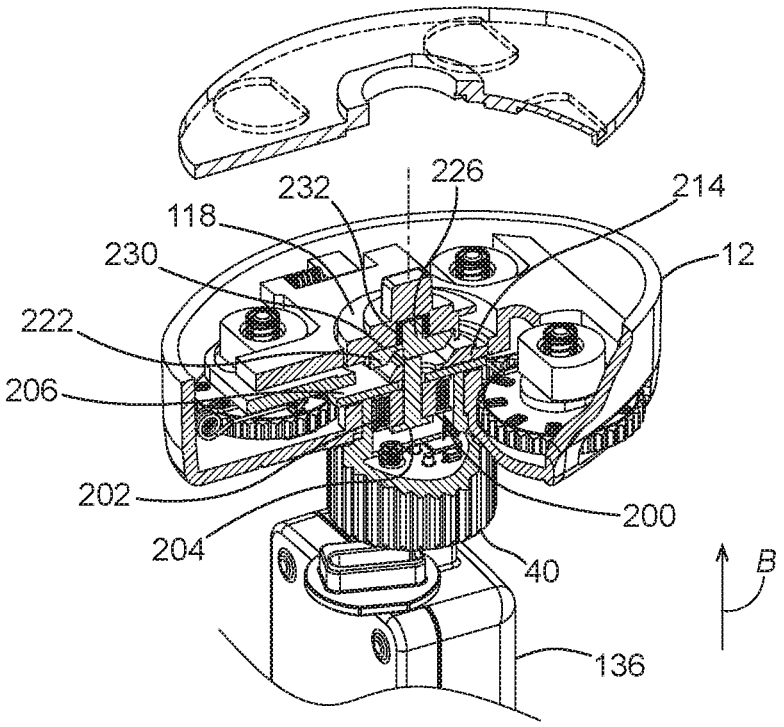
FIG. 28 is a partial cross-section view, taken along line B-B in FIG. 5, of the outer housing disclosed in FIG. 22, in which the electronic key has overridden the mechanical combination lock and placed the outer housing in the unlocked position.

Referring now to FIG. 28, the combination lock 10 can be operated with the electronic key 136 as described earlier. The user first opens the face plate 138 to expose the contacts 142 of the port 140. The user then inserts the contacts of the electronic key 136 into the contacts 142 of the port 140 to power the circuit board 108. The microcontroller reads the access code (or master code) from the electronic key 136; if it matches with the pre-programmed code stored in the memory associated with the microcontroller, the microcontroller allows the electronic key 136 to power the coil 202 of the solenoid actuator 200, and the magnetic field generated by the coil 202 pushes the push rod 204 in direction B, thereby lifting the locking slider 222 off the sliding plate 214 and into the slotted recess 230 of the drive shaft 118. The user can then rotate the knob 40, which will rotate the drive shaft 118, from the closed position to the open position, despite the dials 48 not being in the pre-selected unlocking combination.

Other structures, including other actuators, will be seen by those of skill in the art that can translate the sliders 106, 222 as described above. These other structures could include, for example, electric motors, pneumatic actuators, screw actuators, and the like.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

We claim:

1. A combination lock with electronic override configured to mount to a standard three-hole locker prep on a door, the combination lock comprising:

a knob rotatable between a first position in which the combination lock is in a closed position and a second position in which the combination lock is in an open position;

a plate fixed to the rotatable knob, the plate at least in part defining a slot;

a locking slider disposed in the slot;

a rotatable drive shaft having a recess sized to selectively receive the locking slider, wherein when the locking slider is received in the recess, the knob is operatively connected to the drive shaft and the combination lock is in an unlocked position, and when the locking slider is not received in the recess, the knob is not operatively connected to the drive shaft, and the combination lock is in a locked position;

a circuit board including a microcontroller;

a port in communication with the microcontroller and configured to receive a credential;

an actuator in communication with the microcontroller, the actuator operatively coupled to the locking slider, wherein upon receipt of a predetermined credential by the microcontroller, the microcontroller is configured to instruct that actuator to translate the locking slider into the recess of the drive shaft; and one or more rotatable selectors each having multiple indicia disposed thereon, the one or more rotatable selectors operatively coupled to the locking slider;

wherein rotation of the one or more rotatable selectors to predetermined indicium is configured to selectively place the combination lock in the locked position and the unlocked position; and wherein when the combination lock is in the unlocked position, rotation of the knob causes rotation of the drive shaft to selectively place the combination lock in the closed position and the open position.

2. The combination lock of claim 1, wherein the combination lock does not include a battery compartment.

3. The combination lock of claim 1, the actuator comprising a swing actuator, the swing actuator configured to translate the locking slider in a direction parallel to a plane of rotation of the knob between the unlocked position and the locked position.

4. The combination lock of claim 3, the drive shaft further comprising a cylinder wall extending toward the plate, the recess comprising first and second notches in the cylinder wall.

5. The combination lock of claim 1, the actuator comprising a linear actuator, the linear actuator configured to translate the locking slider in a direction parallel to a plane of rotation of the knob between the unlocked position and the locked position.

6. The combination lock of claim 5, the drive shaft further comprising a cylinder wall extending toward the plate, the recess comprising first and second notches in the cylinder wall.

7. The combination lock of claim 1, the actuator comprising a linear actuator, the linear actuator configured to translate the locking slider in a direction perpendicular to the plane of rotation of the knob between the unlocked position and the locked position.

8. The combination lock of claim 7, the drive shaft further including a cylinder extending toward the plate, the recess being disposed in the cylinder.

9. The combination lock of claim 1, further comprising a cam wheel operatively connected to the rotatable selector, the cam wheel having a periphery comprising a curved surface and a flat surface.

10. The combination lock of claim 9, further comprising a lock plate slidable in a direction parallel to the plane of rotation of the knob, the lock plate comprising a push rod and including a linear bearing surface, wherein when the flat surface of the cam wheel engages the linear bearing surface, the lock plate slides parallel to the plane of rotation of the knob and places the combination lock in the unlocked position.

11. The combination lock of claim 10, further comprising an indicator window, the combination lock further comprising an indicator disposed on the lock plate, wherein the indicator includes a first surface visible through the indicator window in the unlocked position and a second surface visible through the indicator window differentiable from the first surface in the locked position.

12. The combination lock of claim 9, wherein the cam wheel includes a star-shaped recess and the rotatable selector includes a star-shaped drive complementary to the star-shaped recess.

13. The combination lock of claim 12, further comprising a casing and a back plate, the combination lock further comprising a cam plate translatable in a direction parallel to the axis of rotation of the rotatable selector, the cam wheels bearing on the cam plate, wherein upon rotation of the knob from the closed position to the open position, the cam plate translates toward the back plate and pulls the cam wheel off the star-shaped drive.

14. The combination lock of claim 13, wherein the drive shaft further includes a cylindrical cam surface bearing on the cam plate, wherein rotation of the knob rotates the cylindrical cam surface thereby allowing the cam plate to translate toward the back plate.

15. The combination lock of claim 13, wherein the back plate comprises a recess complementary to the outer periphery of the cam wheel, such that when the combination lock is in the open position, the cam wheel is seated within the recess, and the rotatable selector can rotate independent of the cam wheel.

16. The combination lock of claim 1, wherein the port includes electrical contacts.

17. The combination lock of claim 16, further comprising an electronic key, the electronic key having a set of contacts complementary to a set of contacts in the port.

18. The combination lock of claim 17, the electronic key configured to provide sufficient current to power the microcontroller and the actuator.

19. The combination lock of claim 17, wherein the electronic key is configured to supply a credential to the microcontroller, wherein if the credential is the predetermined credential, the microcontroller is configured to actuate the actuator to place the combination lock in the unlocked position.

20. The combination lock of claim 17, wherein the electronic key comprises an administrator's mode, wherein the electronic key is adapted to actuate the actuator, and a manager's mode, wherein the electronic key is adapted to selectively actuate the actuator, delete the preselected credential, and set a new preselected credential.

21. The combination lock of claim 17, wherein the electronic key is configured to provide the predetermined credential, wherein the predetermined credential comprises a serial number and a revision number, and the microcontroller is configured to store the predetermined credential in memory.

22. The combination lock of claim 21, wherein upon connection of the electronic key to the port, the microcontroller is configured to store a new credential in memory if the revision number of the connected electronic key is greater than the revision number of the predetermined credential.

23. The combination lock of claim 1, the knob further comprising a lever extending laterally outward.

24. The combination lock of claim 1, further comprising a locking mechanism having a housing and adapted to receive the drive shaft.

25. The combination lock of claim 24, the locking mechanism further comprising a bolt, a cam, or a slam latch.

26. The combination lock of claim 1 including a plurality of rotatable selectors and a plurality of cam wheels, the lock plate including a plurality of linear bearing surfaces.

27. A locker securable by a combination lock having an electronic override, the locker comprising:

a locker door, a lock housing disposed on the locker door, a knob partially disposed within the lock housing, the knob rotatable between a first position in which the combination lock is in a closed position and a second position in which the combination lock is in an open position;

a plate disposed within the lock housing and fixed to the knob, the plate including a slot, and a locking slider disposed within the slot;

a drive shaft partially disposed within the lock housing and extending out a back side of the lock housing and through the locker door, the drive shaft having a recess sized to selectively receive the locking slider, wherein when the locking slider is received in the recess, the knob is operatively connected to the drive shaft and the lock housing is in an unlocked position, and when the locking slider is not received in the recess, the knob is not operatively connected to the drive shaft, and the lock housing is in a locked position;

a circuit board disposed within the lock housing and including a microcontroller;

an electronic port coupled to the circuit board, an electronically-operated actuator in electronic communication with the microcontroller, the actuator operatively coupled to the locking slider, wherein upon receipt of a predetermined credential by the microcontroller, the actuator translates the locking slider from the locked position to the unlocked position; and a rotatable selector having multiple indicia disposed thereon, the rotatable selector operatively coupled to the locking slider, wherein rotation of the rotatable selector to a predetermined indicium shifts the lock housing between the locked position and the unlocked position; and a locking mechanism disposed on a side of the locker door opposite of the lock housing, the locking mechanism including a rotatable shaft configured to receive the drive shaft;

wherein when the combination lock is in the unlocked position, rotation of the knob is configured to cause rotation of the rotatable shaft of the locking mechanism to selectively place the combination lock in the closed position and the open position.

28. The locker of claim 27, wherein the lock housing and the locking mechanism are secured to the locker door via fasteners in a three-hole prep in the locker door.

29. The locker of claim 27, wherein the lock housing and the locking mechanism are integral with the locker door.

* * * * *